US011030848B2

(12) United States Patent
Shiraishi

(10) Patent No.: US 11,030,848 B2
(45) **Date of Patent: *Jun. 8, 2021**

(54) GAMING MACHINE, CONTROL METHOD FOR MACHINE, AND PROGRAM FOR GAMING MACHINE

(71) Applicant: Konami Gaming, Inc., Las Vegas, NV (US)

(72) Inventor: Kazutaka Shiraishi, Las Vegas, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 4 days.

This patent is subject to a terminal disclaimer.

(21) Appl. No.: 16/433,808

(22) Filed: Jun. 6, 2019

(65) Prior Publication Data

US 2019/0287337 A1 Sep. 19, 2019

Related U.S. Application Data

(63) Continuation of application No. 15/389,233, filed on Dec. 22, 2016, now Pat. No. 10,360,753.

(51) Int. Cl.
*G07F 17/32* (2006.01)
*G07F 17/34* (2006.01)

(52) U.S. Cl.
CPC ..... *G07F 17/3213* (2013.01); *G07F 17/3225* (2013.01); *G07F 17/3244* (2013.01); *G07F 17/3267* (2013.01); *G07F 17/34* (2013.01)

(58) Field of Classification Search
CPC ..... G07F 17/3213; G07F 17/3225; G07F 17/3244; G07F 17/34
See application file for complete search history.

(56) References Cited

U.S. PATENT DOCUMENTS

| | | | |
|---|---|---|---|
| 2002/0045474 | A1 | 4/2002 | Singer et al. |
| 2004/0082384 | A1 | 4/2004 | Walker et al. |
| 2008/0167125 | A1 | 7/2008 | Dias Pires et al. |
| 2008/0248865 | A1 | 10/2008 | Tedesco et al. |
| 2009/0075722 | A1 | 3/2009 | Louie et al. |
| 2011/0065493 | A1 | 3/2011 | Parham |
| 2011/0105218 | A1 | 5/2011 | Anderson et al. |
| 2013/0072286 | A1 | 3/2013 | Suda |
| 2017/0193756 | A1 | 7/2017 | Schmidt et al. |
| 2017/0301177 | A1 | 10/2017 | Pawloski |

OTHER PUBLICATIONS

International Search Report and Written Opinion (International Application No. PCT/US 17/60126; dated Jan. 17, 2018; 9 pages.

*Primary Examiner* — Werner G Garner
(74) *Attorney, Agent, or Firm* — Howard & Howard Attorneys PLLC

(57) ABSTRACT

A gaming machine provides an operation unit, a display unit, and a control unit. The operation unit is an operation of the player. The display unit is operably coupled to the operation unit and is configured to display first and second display areas. A number of free bonus may be awarded during a primary game. During the free spins, any occurrences of a predetermined symbol is copied to the second display area. After the free spins, a secondary bonus may be provided using the second display area and the copied symbols.

26 Claims, 30 Drawing Sheets

FIG. 4

| 71 | 72 | 73 | 74 | 75 |
|---|---|---|---|---|
| PicB | Wild | PicB | PicD | J |
| Q | Wild | PicA | Q | PicA |
| K | Wild | J | A | 10 |
| Wild | Trigger | Q | PicB | 9 |
| Wild | 9 | PicD | PicD | J |
| Wild | J | Wild | Q | PicA |
| K | PicC | J | A | 10 |
| PicA | Trigger | Q | Wild | 9 |
| 9 | A | PicA | Wild | Wild |
| Trigger | PicA | K | Wild | Wild |
| J | Wild | Trigger | Trigger | Wild |
| PicC | Wild | PicC | inn | PicC |
| Wild | Wild | A | inn | Trigger |
| Wild | inn | J | inn | 10 |
| Wild | inn | inn | inn | inn |
| A | inn | inn | inn | inn |
| Q | inn | inn | J | inn |
| PicD | inn | Wild | Q | inn |
| J | A | Wild | PicC | inn |
| inn | J | Wild | A | PicA |

70

60

GAMING MACHINE, CONTROL METHOD FOR MACHINE, AND PROGRAM FOR GAMING MACHINE

CROSS-REFERENCE TO RELATED APPLICATION

This application is a continuation of U.S. patent application Ser. No. 15/389,233, filed Dec. 22, 2016, the disclosure of which is hereby incorporated by reference in its entirety.

TECHNICAL FIELD

The present invention relates to a gaming machine, a control method for a gaming machine, and a program for a gaming machine.

BACKGROUND ART

A gaming machine represented by a slot machine is highly popular among casino customers as a device that provides gaming that is easy to enjoy, and recent statistics report that sales from gaming machines account for the majority of casino earnings. Initial slot machines were simple devices, wherein an inserted coin is received, a configured reel rotates and stops mechanically according to a handle operation, and a win or a loss is determined by a combination of symbols stopped on a single pay line. However, recent gaming machines, such as mechanical slot machines driven by a highly accurate physical reel via a computer controlled stepping motor, video slot machines that display a virtual reel on a display connected to a computer, and various gaming machines that apply similar technology to other casino games are quickly advancing. For the manufacturers that develop these gaming machines, an important theme is to provide an attractive game that strongly attracts casino customers as players, and improves the functionality of the gaming machine.

SUMMARY OF INVENTION

In one aspect of the present invention, a gaming machine is provided. The gaming machine includes an operation unit, a display unit, and a control unit. The operation unit is configured to receive an operation of a player. The display unit is operably coupled to the operation unit and is configured to display a first display area and a second display area. The first display area includes a first plurality of cells arranged in a first grid. The second display area includes a second plurality of cells arranged in a second grid. The control unit is operably coupled to the operation unit and the display unit and being configured to initiate a primary game in response to player operation and to establish an outcome of the primary game. The control unit is further configured to detect a trigger condition and to responsively establish a number of free games. The control unit, in providing the free games, being further configured to:

for each free game, randomly select a plurality of symbols associated with the first display area, each symbol in the plurality of symbols being associated with one of the plurality of cells in the first grid, the plurality of symbols forming an interim outcome, detect an occurrence of a predetermined symbol in the first display area, the occurrence of a predetermined symbol being associated with one of the cells of the first display area, copy the occurrence of a predetermined symbol from the first display area to a corresponding cell in the second display area, wherein any copied occurrence of the predetermined symbol in the second display area is retained for each remaining free game, wherein a complementary award is provided to the player if the corresponding cell in the second display area is already occupied with an occurrence of the predetermined symbol, and provide a secondary bonus game using the second grid area. The control unit, in providing the secondary bonus game, is further configured to randomly select a symbol for each unoccupied cell in the second display grid. The randomly selected symbol(s) and the copied occurrences of the predetermined symbol form a secondary bonus game outcome.

In another aspect of the present invention, a control method for providing a game to a player using a gaming machine is provided. The gaming machine including an operation unit, a display unit, and a control unit. The operation unit is configured to receive an operation of a player. The display unit is operably coupled to the operation unit and is configured to display a first display area and a second display area. The first display area includes a first plurality of cells arranged in a first grid. The second display area includes a second plurality of cells arranged in a second grid. The control unit is operably coupled to the operation unit and the display unit. The control method includes the steps of initiating a primary game in response to player operation and establishing an outcome of the primary game, detecting a trigger condition and responsively establishing a number of free games. The control method, in providing each free games, including the step of randomly selecting a plurality of symbols associated with the first display area. Each symbol in the plurality of symbols being associated with one of the plurality of cells in the first grid. The plurality of symbols forming an interim outcome. During each free game, the method also includes the steps of detecting an occurrence of a predetermined symbol in the first display area and copying the occurrence of a predetermined symbol from the first display area to a corresponding cell in the second display area. The occurrence of the predetermined symbol in the first display area is associated with one of the cells of the first display area. Any copied occurrence of the predetermined symbol in the second display area is retained for each remaining free game. A complementary award is provided to the player if the corresponding cell in the second display area is already occupied with an occurrence of the predetermined symbol. A secondary bonus game is provided using the second grid area. The control method, in providing the secondary bonus game, further includes the step of randomly selecting a symbol for each unoccupied cell in the second display grid. The randomly selected symbol(s) and the copied occurrences of the predetermined symbol form a secondary bonus game outcome.

In still another aspect of the present invention, a program for a gaming machine provides a game to a player. The gaming machine includes an operation unit, a display unit, and a control unit. The operation unit is configured to receive an operation of a player. The display unit is operably coupled to the operation unit and configured to display a first display area and a second display area. The first display area includes a first plurality of cells arranged in a first grid. The second display area includes a second plurality of cells arranged in a second grid. The control unit is operably coupled to the operation unit and the display unit. The program performs the steps of initiating a primary game in response to player operation and establishing an outcome of the primary game, detecting a trigger condition and responsively establishing a number of free games. The program, in providing each free games, performs the step of randomly selecting a plurality of symbols associated with the first display area. Each symbol in the plurality of symbols being associated with one of the plurality of cells in the first grid. The plurality of symbols forming an interim outcome. During each free game, the program performs the steps of detecting an occurrence of a predetermined symbol in the first display area and copying the occurrence of a predetermined symbol from the first display area to a corresponding cell in the second display area. The occurrence of the predetermined symbol in the first display area is associated with one of the cells of the first display area. Any copied occurrence of the predetermined symbol in the second display area is retained for each remaining free game. A complementary award is provided to the player if the corresponding cell in the second display area is already occupied with an occurrence of the predetermined symbol. A secondary bonus game is provided using the second grid area. The program, in providing the bonus game, further performs the step of randomly selecting a symbol for each unoccupied cell in the second display grid. The randomly selected symbol(s) and the copied occurrences of the predetermined symbol form a secondary bonus game outcome.

BRIEF DESCRIPTION OF DRAWINGS

FIG. 4 is a figure showing an exemplary symbol arrangement showing the order of symbols displayed on the first display area, according to an embodiment of the present invention.

DETAILED DESCRIPTION OF EMBODIMENTS

A gaming machine, according to an embodiment of the present invention, referencing the attached figures is described in detail below. Further, duplicated descriptions will be omitted for identical attached symbols in identical or corresponding parts in each figure.

With reference to the drawings, and in operation, the present invention is directed towards a gaming machine, a control method for a gaming machine, and a program for a gaming machine that provides a game to a player. In one embodiment, the game includes a primary game and a feature or bonus game. As will be discussed in further detail below, the primary and/or bonus game, upon the occurrence of an appropriate triggering condition, may copy symbols from a first grid 60 in a first display area 61 to a second grid 62 in a second display area 63.

Figure 1A:
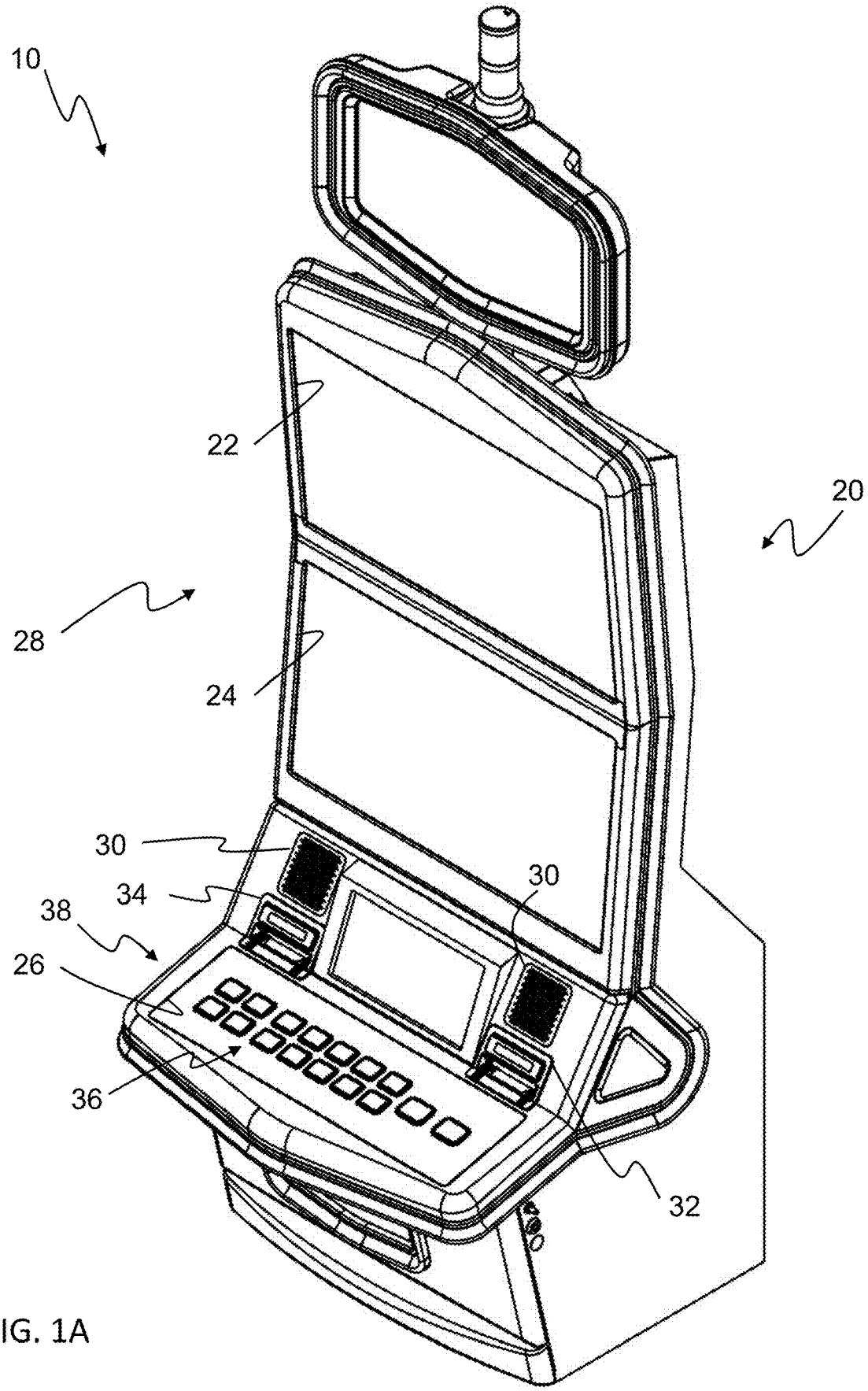
FIG. 1A is a perspective view of the gaming machine, according to the first embodiment.
Figure 1B:
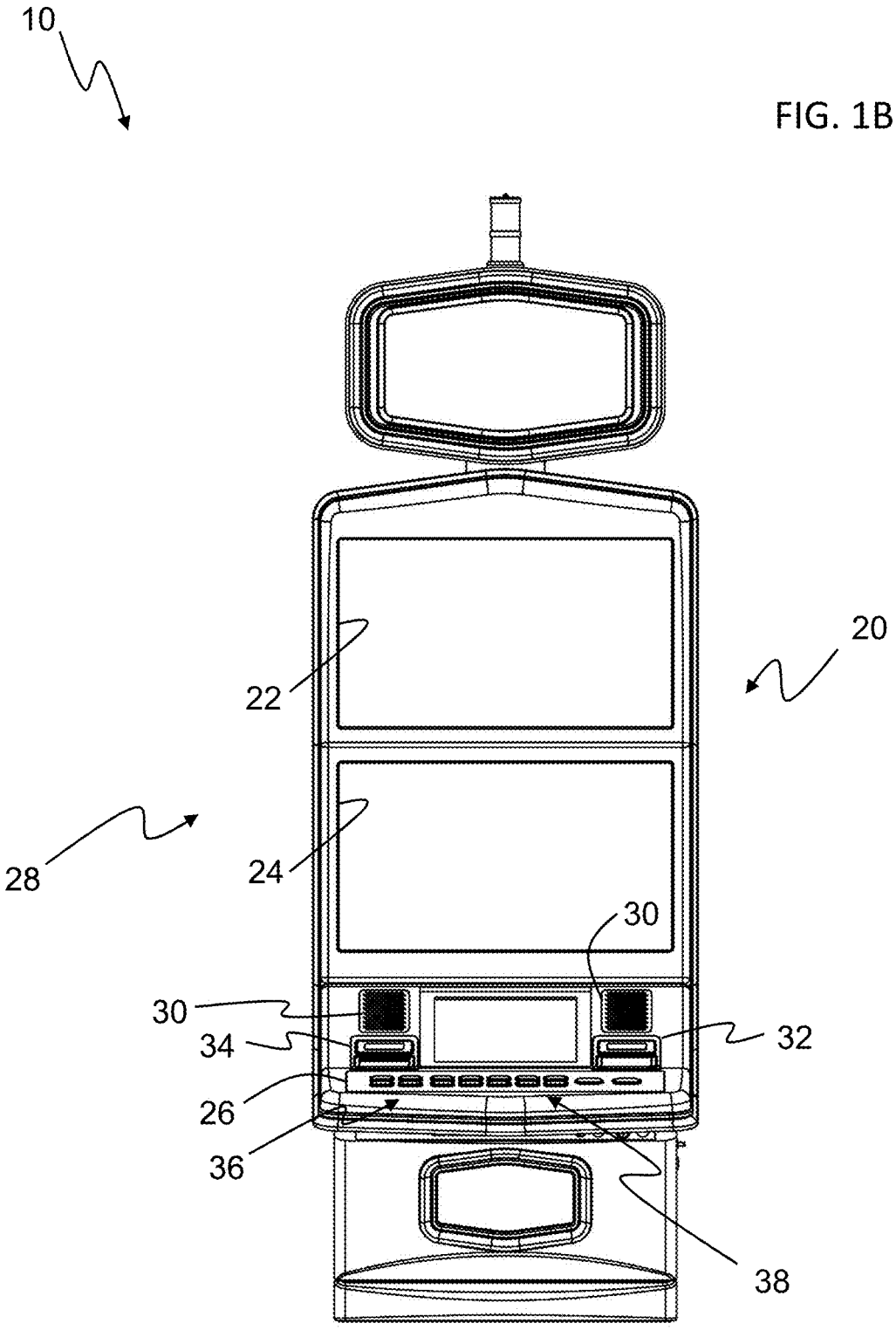
FIG. 1B is a front view of the gaming machine of FIG. 1A.

The gaming machine according to the present embodiment, receives a predetermined game value from the player, generates a game result, and provides a payout to the player according to the game result. FIG. 1A and FIG. 1B are a perspective view and a front view, respectively, of a gaming machine 10, according to the present embodiment. As shown in FIG. 1, this gaming machine 10 provides a cabinet 20 providing an upper display 22, a lower display 24, a control panel 26 and may also house a player tracking or ranking unit 57 (see FIG. 2). The cabinet 20 also houses a control unit 50 (see FIG. 2) that controls each part (see below). The control unit 50 also implements a random number generator (RNG) that is used during operation of the game. Each configuration is described below.

The upper display 22 and the lower display 24 may be flat panel display devices, such as both liquid crystal display devices and organic EL display devices and the like, and by controlling via each control unit 50, the display area mentioned below functions as a display unit 28 provided to the player.

Speakers 30 are provided on the left and right of the cabinet 20, and by controlling via the control unit 50, sound is provided to the player. On the control panel 26, a bill/ticket identification unit 32, the printer unit 34, and an operation unit 36 are provided.

The player tracking unit 57 may be housed on the center of the front surface of the cabinet 20 below the lower display 24. The player tracking unit 57 has a card reader that recognizes a player identification card, a display that presents data to the player, and a keypad that receives input by the player. This type of player tracking unit 57 reads information recorded on the player identification card inserted by the player into the card reader, and displays the information and/or information acquired by communicating with the external system on the display, by cooperatively operating with the control unit 50 mentioned below or an external system. Further, input from the player is received by the keypad, the display is changed according to the input, and communication with the external system is carried out as necessary.

The bill/ticket identification unit 32 is disposed on the control panel 26 in a state where the insertion opening that a bill/ticket is inserted into is exposed, an identification part that identifies a bill/ticket by various sensors on the inside of the insertion opening is provided, and a bill/ticket storage part is provided on the outgoing side of the identification part. The bill/ticket identification unit 32, receives and identifies bills/tickets (including vouchers and coupons) that are the game value as a game executing value, and notifies the control unit 50 mentioned below.

The printer unit 34 is disposed on the control panel 26 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The printer unit 34, under the control of the control unit 50 mentioned below, prints information on paper and outputs a ticket according to credit payout processing from the gaming machine 10. The output ticket can use the payout credit as game play by being inserted into the bill/ticket identification unit 32 of another gaming machine, or, can be exchanged for cash by a kiosk terminal inside of the casino or a casino cage.

The operation unit 36 receives the operation of the player. The operation unit 36 includes a group of buttons 38 that receives various instructions from the player on the gaming machine 10. The operation unit 36, for example, may include a spin button and a group of setting buttons. The spin button receives an instruction to start (start rotating the reel) the game listed below. The group of setting buttons 38 includes a group of bet buttons, a group of line-designation buttons, a max bet button, and a payout button and the like. The group of bet buttons receives an instruction operation regarding the bet amount of credits (bet number) from the player. The group of line-designation buttons receive an instruction operation that designate a pay line (referred to as an effective line below) subjected to a line judgment below from the player. The max bet button receives an instruction operation regarding the bet of the maximum amount of credits that can be bet at one time from the player. The payout button receives an instruction operation instructing a credit payout accumulated in the gaming machine 10.

Figure 2:
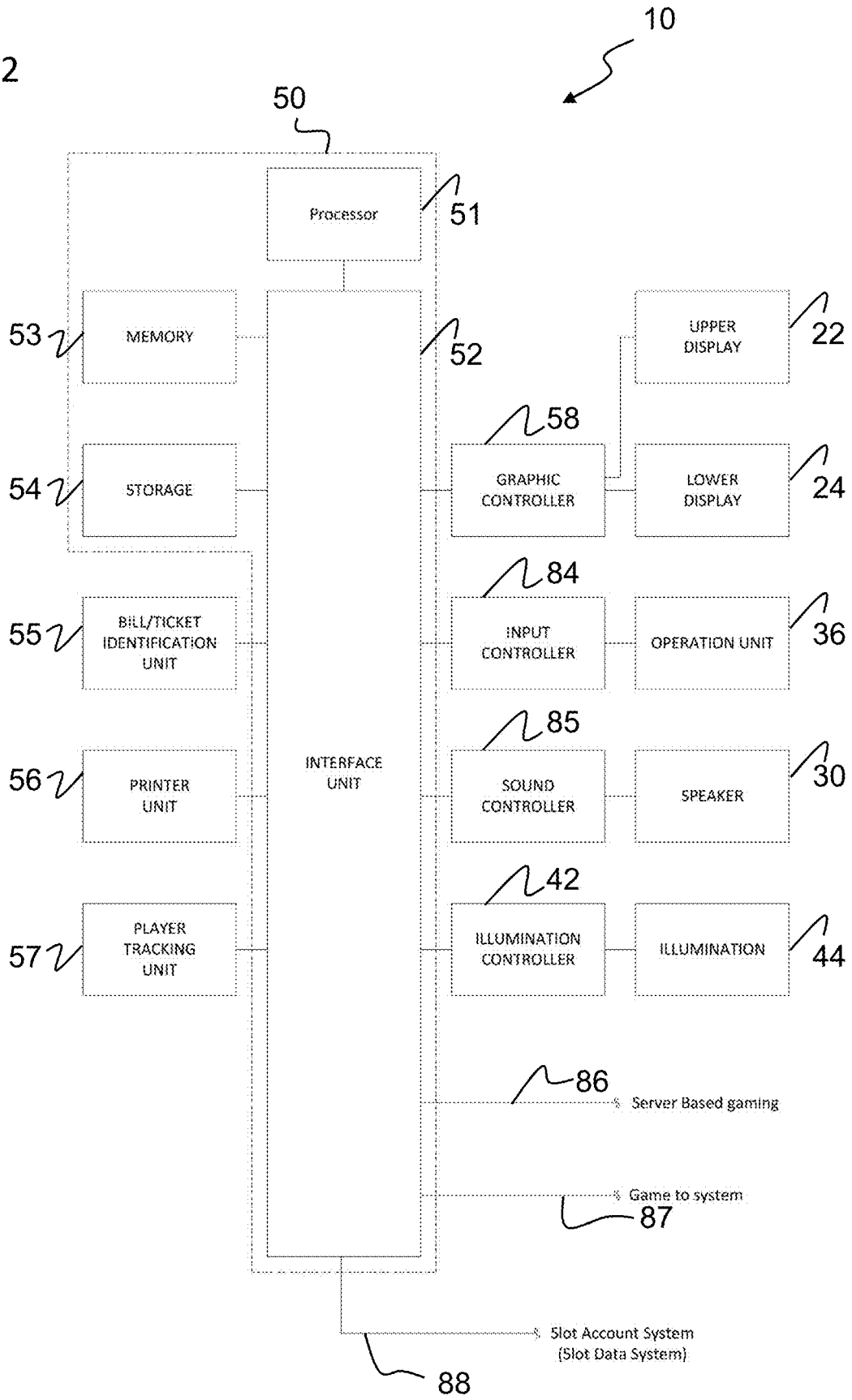
FIG. 2 is a functional block diagram of the gaming machine in FIG. 1.

With reference to FIG. 2, further on the inside of cabinet 20, a control board equipped with a central processing unit 51 (abbreviated as CPU below) that configures the control unit 50, an interface unit (or part) 52, a memory 53 and a storage 54 and the like are incorporated. The control board is configured so that communication is possible through the interface unit 52 and each of the components equipped on the cabinet 20, controls the operation of each part by executing the program recorded in the memory 53 or the storage 54 of the CPU 51, and provides a game to the player.

FIG. 2 shows a functional block diagram of the gaming machine 10, according to the present embodiment. The gaming machine 10 provides the control unit 50. The control unit 50 is configured as the interface unit 52 including a chip set providing communication functions of the CPU 51, a memory bus connected to a CPU 51, various expanding buses, serial interfaces, USB interfaces, Ethernet (registered trademark) interfaces and the like, and a computer unit where the CPU 51 provides the addressable memory 53 and the storage 54 through the interface unit 52. The memory 53 can be configured to include RAM that is a volatile storage medium, ROM that is a nonvolatile storage medium, and EEPROM that is a rewritable nonvolatile storage medium. The storage 54 provides the control unit 50 as an external storage device function, can use reading devices such as a memory card that is a removable storage medium, and a magneto optical disk and the like, and can use hard disks.

On the interface unit 52, in addition to the CPU 51, the memory 53, and the storage 54, a bill/ticket identification unit 55, a printer unit 56, the player tracking unit 57, a graphic controller 58, an input controller 84, and a sound controller 85 are connected. That is, the control unit 50 is connected to the operation unit 36 through the input controller 84, and connected to the upper display 22 and/or the lower display 24 through the graphic controller 58. Further, when illumination 44 that provides decorative lighting to the gaming machine 10 is provided, the illumination is controlled under the control of the control unit 50 on the interface unit 52, and an illumination controller 42 that provides a decorative lighting effect may be connected.

The control unit 50, which includes memory 53 and storage 54, controls each part by executing a program stored in the memory 53 and the storage 54, and provides a game to the player. Here, for example, the memory 53 and storage 54 may be configured to store a program and data of an operating system and subsystem that provide the basic functions of the control unit 50 to the EEPROM of the memory 53, and stores a program and data of an application that provides a game to the storage 54. According to such a configuration, it can be easy to change or update a game by replacing the storage 54. Further, the control unit 50 may be a multiprocessor configuration that has a plurality of CPUs.

Each block connected to the control unit 50 is described below. The bill/ticket identification unit 55 corresponds to the bill/ticket identification unit 32, receives bills/tickets in the insertion opening, and notifies the control unit 50 of identifying information corresponding to the assortment of bills or the payout processing of credits. The bill/ticket identification unit 55 notifies the information to the control unit 50, and the control unit 50 increases the usable credit amount inside of the game according to the notified content. The printer unit 56 corresponds to the printer unit 34, and under the control of the control unit 50 that receives an operation of the payout button of the group of setting buttons 38, information corresponding to the credit payout processing from the gaming machine 10 is printed and output on a printed ticket.

The player ranking (or tracking unit) unit 57 cooperatively operates with the control unit 50, and sends and receives information and the like of the player from the casino management system. The graphic controller 58 controls the upper display 22 and the lower display 24, under the control of the control unit 50, and displays a display image that includes various graphic data. The sound controller 85 drives the speakers 30 under the control of the control unit 50, and provides various sounds such as an announcement, sound effects, BGM and the like.

Further, the interface unit 52, has various communication interfaces for communicating with the exterior of the gaming machine 10, for example the interface unit 52 can communicate with an external network by Ethernet 86, 87, and a serial interface 88. In the present embodiment, one example shows when there is communication between a well-known server side gaming network (Server Based Gaming of FIG. 2), a G2S network (Game to System of FIG. 2), and a slot information system (Slot Data System of FIG. 2), respectively.

Figure 3A:
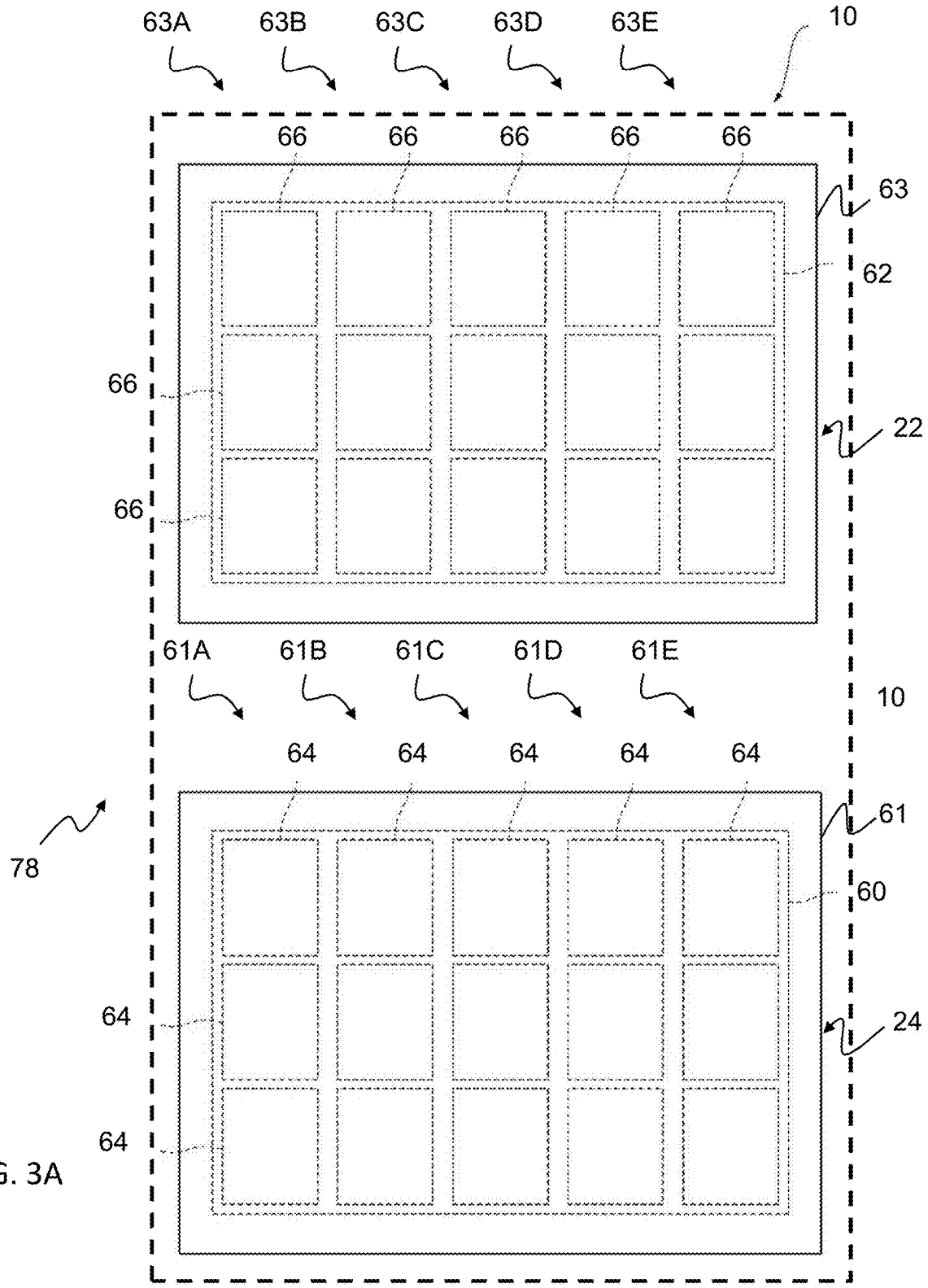
FIG. 3A is a first diagrammatic illustration of first and second display areas of the gaming machine in FIG. 1, according to an embodiment of the present invention.
Figure 3B:
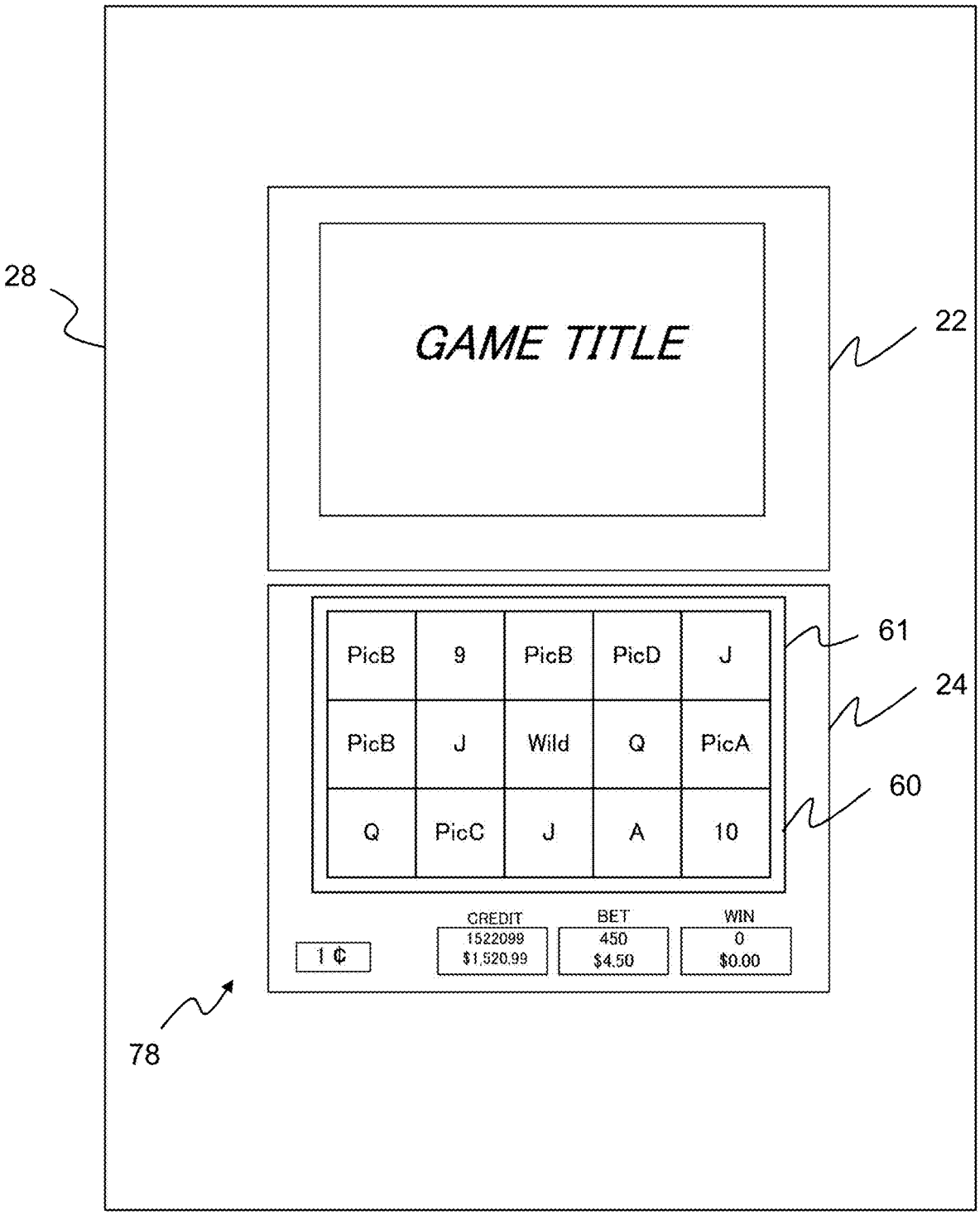
FIG. 3B is a second diagrammatic illustration of the first and second display areas of FIG. 3A, according to an embodiment of the present invention.

FIG. 3A and FIG. 3B schematically show a display area 78[sk1][JY2] provided by the gaming machine 10. Such a display area 78 is displayed on the display unit 28 (the upper display 22 and/or the lower display 24) by the control unit 50 executing a predetermined program. In the illustrated embodiment, the display area 78 is displayed on the lower display 24 and the upper display 22. With reference to FIG.

3A, the display area 78 includes a first display area 61 and a second display area 63. In one embodiment, the first display area 61 is displayed on the lower display 24 and the second display area 63 is displayed on second display 22. However, it should be noted that the first and second display areas 61, 63 may be displayed on a single display. With specific reference to FIG. 3B, in one embodiment, the second display area 63 may be displayed only when needed or desired. For instance, as shown, during the primary game the upper display 22 may be utilized to display game related information, e.g., game title information and/or graphics.

In one aspect of the present invention, the gaming machine 10 provides a game to the player. The game may include a primary game and a bonus or feature game. For instance, the primary game may be a video slot game, and the bonus game may be the awarding of a number of free games or spins in response to the occurrence of a trigger condition, e.g., during the primary game. During the free spins, a feature may be provided in which a predetermined symbol appearing in an outcome of each free spin may be copied from the first grid to the second grid.

The game of the present invention utilizes the first grid 60 in the first display area 61 during the primary game and the bonus game, i.e., the free spins. The present embodiment shows the state of displaying the first display area 61 on the lower display 24. As shown in FIG. 3A, the first display area 61 includes the first grid 60 for displaying symbols. By using such a display area, the gaming machine 10 of the present embodiment operates as a slot machine that pays a payout according to a winning combination of symbols displayed on the first display area 61.

The display unit 28 displays a plurality of symbols in the first grid 60. The first grid 60 has a plurality of rows (r) and columns (c). The first grid 60 is configured by a plurality of cells 64 that are the stop position of symbols. In some embodiments of the present invention, the first grid 60 includes an odd number of columns. In other embodiments of the present invention, the grid 60 includes an even number of columns. In the embodiment shown in FIG. 3A, the first grid 60 includes 15 cells 64 disposed in a grid shape of 3 rows and 5 columns.

In the next several embodiments, the present invention will be described with respect to a 3×5 grid, however, it should be noted that the present invention is not limited to a grid with any specific size and/or shape. Furthermore, the below discussion describes a game having a primary game and a bonus game. The bonus game provides a plurality of free games and/or spins. The copy feature described below is provided during the bonus game.

With reference to FIG. 3B, the first grid 60 is displayed on the lower display 24. The upper display 22 may be used to display animations and/or game identifying information during the primary game and/or during an attract mode. Further, the display unit 28 can display a decorative area, and an area that displays credit amount, bet number, and a credit amount obtained by winning (WIN number) and the like, outside of the first grid 60. On each of the plurality of cells 64 of the display area 61, one symbol is stopped and displayed.

On each cell 64 of the first grid 60, as shown in FIGS. 3B and 4, a symbol is displayed based on the symbol arrangement of virtual reel strips 71 to 75 configured of a virtual reel set 70. That is, the cells 64 of the first grid 60 correspond to the virtual reel strips 71 to 75 by column, and the symbols disposed on predetermined parts of each virtual reel strip 71 to 75 are displayed. Furthermore, by moving (scrolling or spinning) each symbol by column based on the symbol arrangement of the virtual reel strips 71 to 75, the symbols displayed in the cells 64 of the first grid 60 change, and by stopping the movement (scrolling or spinning) by columns, the symbols are stopped. Here, the virtual reel strips 71 to 75 are data where the control unit 50 uses a program having the memory 53 or the storage 54, and data showing the symbol arrangement (i.e., the order of symbols on each reel) regulated by each cell column. Further, the virtual reel set 70 is a general term for such virtual reel strips 71 to 75.

Figure 5:
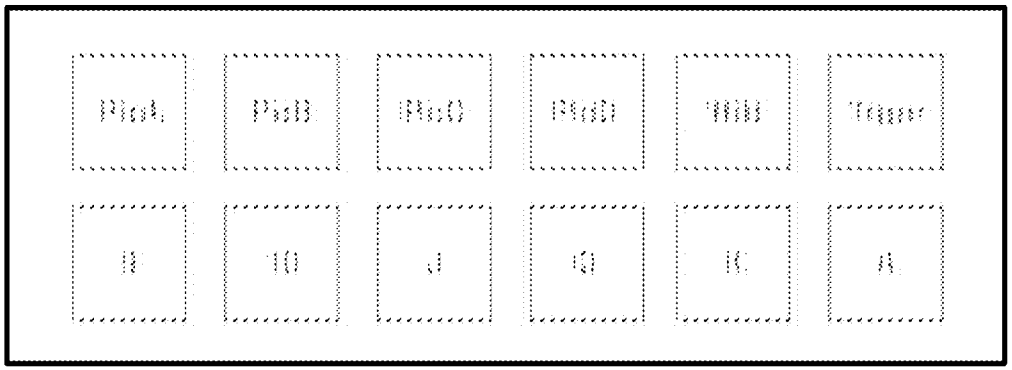
FIG. 5 is a figure showing the symbols displayed on the display area, according to an embodiment of the present invention.

Each virtual reel strip 71-75, in the examples of FIG. 4, is configured by 20 symbols in respective symbol positions, and those symbols are aligned in an order defined by each reel. FIG. 5 is the details of symbols of the figure shown in FIG. 4. Each virtual reel strip 71-75 includes symbols selected from a symbol set of 12 varieties shown in FIG. 5. This symbol set includes card symbols ("9", "10", "J", "Q", "K", and "A") that imitate playing cards as regular symbols, and picture symbols ("PIC-a", "PIC-b", "PIC-c", and "PIC-d") that show a pattern. Further, this symbol set includes a wild symbol ("Wild") that is substituted as another symbol when a win is determined and a trigger or symbol ("Trig") that is used to determine if a feature or feature game is to be played (see below). Each of these symbols have a different rank from each other regarding their value when winning, their rank gradually raises in this order: "9", "10", "J", "Q", "K", "A", "PIC-d", "PIC-c", "PIC-b", "PIC-a". A combination of symbols that includes high-ranking symbols when winning, can obtain a larger winning payout compared to a combination of low-ranking symbols when winning. Further, each virtual reel strip 71-75 may include one or more variable symbols ("inn") that is transformed into one of the other symbols, e.g., "9", "10", "J", "Q", "K", "A", "PIC-d", "PIC-c", "PIC-b", "PIC-a", (see FIG. 5) for each game or spin.

It should be noted that in the illustrated embodiment, each column of the first grid 60 has a corresponding reel strip. When the reel strip stops, a symbol from the respective reel strip appears in each one of the cells of the respective column of the first grid 60. In an alternative embodiment, however, each cell 64 of the first grid 60 has a respective independent reel that may spin independently of the other reels. Each cell 64 of the first grid may, thus, have an independent reel with a corresponding virtual reel strip.

Returning to FIG. 3A, the second grid 62 may be controllably displayed in the second display area 63 on the upper display 22. In one embodiment of the present invention, the second grid 62 has the same number of cells as the first grid 60 and has the same number of rows and columns. In one aspect of the present invention, each cell 66 in the second grid 62 is associated with a corresponding cell 64 in the first grid 60. In one embodiment, the corresponding cell 64 is in the same row and column as the respective cell 66 in the second grid 62, In the next several embodiments, the present invention will be described with respect to a 3×5 grid, however, it should be noted that the present invention is not limited to a grid with any specific size and/or shape. Furthermore, the below discussion describes a game having a primary game and a bonus game. The bonus game provides a plurality of free games and/or spins. The copy feature described below is provided during the bonus game.

In general, the control unit 50 starts a game (either the primary game or a free spin in the bonus game), determines the stop position of each virtual reel strip 71 to 75 randomly, the virtual reel strips 71 to 75 move from a current position, and the operation to stop on a stop position uses the display unit 28 (for example, the lower display 24) and is expressed.

Due to this, in the display or grid 62, the symbols included on the virtual reel strips 71 to 75 are continuously moved (scrolled or spun) in the vertical direction of the display area 61, and one symbol of one cell 64 aligned in an order of the symbol based on the symbol arrangement is stopped so that it is displayed.

The control unit 50 changes and stops the plurality of symbols displayed on the display unit 28 according to the operation of the player received by the operation unit 36, and a payout may be paid according to the stopped symbols inside the display area 61.

In the display area 61, a pay line is set that is used when winning is determined. The pay line is set to be extended over the column on the right end from the cells of the column of the left end, and is a line that combines the plurality of cells 64 determining a win. The number of effective lines within the set pay line is selected by the operation of a group of line designation buttons included in the group of setting buttons 38 of the operation unit 36 for the player. The control unit 50, in regards to the result of a game that is a combination of symbols, determines a win when a predetermined number of identical symbols is surpassed and aligned on a set pay line, and pays a payout to the player according to the type and number of symbols. On the gaming machine 10 of the present embodiment, a predetermined number of pay lines (LINE 1-40) of cells with three rows and five columns in the display area 61 is set (see FIG. 6). The system for determining a win may determine a win when a predetermined number of identical symbols from cells of the column on the left end are aligned on a set pay line, may determine a win when a predetermined number of identical symbols from cells of the column on the right end are aligned on a set pay line, and may determine a win when a predetermined number of identical symbols are aligned on a continuous column on a predetermined pay line.

Figure 6:
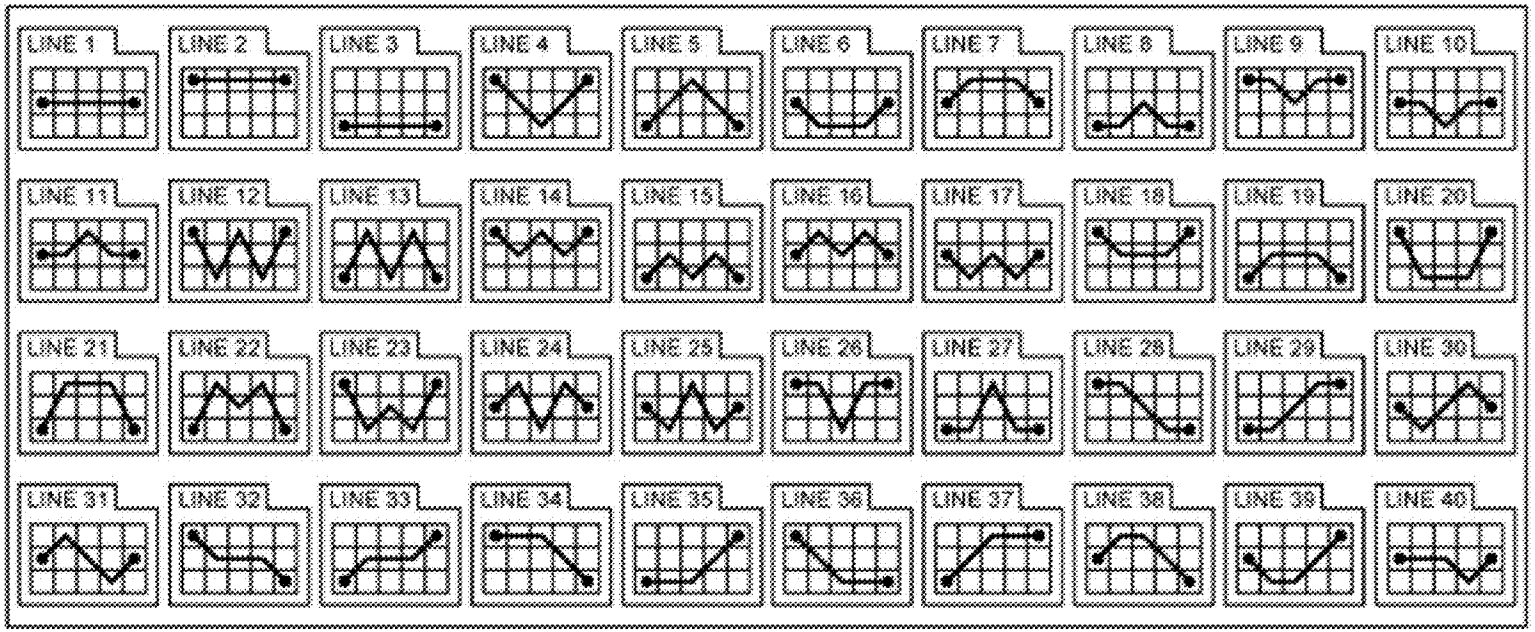
FIG. 6 is a figure showing one example of a pay line set on the determination area in FIG. 3.

It should be noted that pay lines shown other than (or in addition to) the pay lines shown in FIG. 6 may be used. In general, the pay lines shown in FIG. 6 start in the first column and end in the last column, and include one cell per column. However, one or more pay lines could include one or more cells in the same column and may include a vertical pay line.

The gaming machine 10 of the present embodiment may provide two types of games, a primary game (also referred to as a main game) and a special game (referred to as a bonus game, or feature game, and includes providing one or more free games or spins that do not consume game value) provided when predetermined conditions are satisfied. Concerning a primary game and a feature game, the symbols displayed in the display area 61 configure a combination of symbols that are the result of a game, and determine a win.

In one embodiment of the present invention, the gaming machine 10 includes the operation unit 36, a display unit 22, 24 and a control unit 50. The operation unit is configured to receive an operation of a player (see above). The display unit is operably coupled to the operation unit and is configured to display a symbol display area. The symbol display area includes a plurality of cells 64 arranged in a grid 60. As discussed above, the grid 60 has a plurality of rows and a plurality of columns.

The control unit 50 is operably coupled to the operation unit and the display unit and is configured to initiate a game in response to player operation and to establish an outcome of the game. The control unit 50, in response to initiation of the game, being randomly selects a plurality of symbols associated with the symbol display area 61 or grid 60. Each symbol in the plurality of symbols is associated with one of the plurality of cells 64 in the grid 60. The plurality of symbols forms the outcome of the primary game.

In some embodiments, each symbol in the outcome of the primary game may be randomly selected. In the illustrated embodiment, the game is a video slot game. As discussed above, each column has an associated reel strip. In randomly selecting the symbols in the interim outcome, the control unit 50 randomly determines a stop position (using a random number generator or RNG) for each reel strip and displays the interim outcome in a manner to simulate rotating reels. The symbols in each column in the outcome is a function of the associated reel strip and the randomly determined stop position.

The control unit 50 determines if a trigger condition has occurred during the primary game. If the trigger condition has occurred, then a predetermined or random number of free spins are awarded to the player. During the free spins, the second grid 62 is displayed in the second display area 63. During each free spin, the appearance of a predetermined symbol, e.g., a Wild symbol, in the outcome of the free spin (in the first grid 60) is copied to an associated or corresponding cell in the second grid 62. The copied symbols are retained in the second grid 62 during the remaining free spins and utilized in a bonus spin in the second grid 62. If a copied predetermined symbol already exists in the associated or corresponding cell in the second grid 62, then the player may be awarded an extra award (see below).

In one embodiment the trigger condition is the appearance a predetermined symbol or symbols in the interim outcome. The predetermined symbol may be randomly determined (and unknown) to the player, i.e., a mystery trigger.

As discussed above, the associated reel strip of at least one column in the left plurality of columns includes an identical symbol in a plurality of adjacent symbol positions and the associated reel strip of at least one column in the right plurality of columns includes the identical symbol in a plurality of adjacent symbol positions. In other embodiments, the trigger condition may be the appearance or occurrence of one or a plurality of the identical symbols in the interim outcome. In one embodiment, the trigger condition is at least one of the identical symbols in the plurality of adjacent symbol positions occurring in the interim outcome. In another embodiment, the trigger condition is at least one of the identical symbols in the plurality of adjacent symbol positions occurring in the interim outcome. In still another embodiment, trigger condition is the occurrence of the identical symbol from the plurality of adjacent symbol positions in all of the cells 64 of a column (see below). In one embodiment, the identical symbol in the plurality of adjacent symbol position may be randomly determined. In another embodiment the identical symbol is a wild symbol.

It should be noted that the trigger condition may be any suitable condition or set of conditions that may occur in the game, or occur independent of the game, e.g., from an outside source such as a player tracking system. The trigger condition may be a mystery trigger event, i.e., an event which while related to the main game, is not visible or part of or shown within the outcome of the game. This type of mystery trigger event may be caused based on dedicated random number separated from random numbers that is used to determine the stop positions of each reel.

In some embodiments of the present invention, the virtual reels stop in a predetermined order, for example, from left to right.

As discussed above, the game may also include a bonus game. The bonus game may include one or more free spins. In one embodiment, the bonus game is triggered by the occurrence of one or more predetermined symbols, e.g., a scatter symbol in the outcome of the primary game.

In a first aspect of the present invention, the gaming machine 10 includes the operation unit 36, the display unit 28, and the control unit 50. As described in more detail below, the gaming machine 10 is configured to provide a game to the player. The game includes a primary game and a bonus game. The bonus game includes a number of free spins with a copy feature (see below). The operation unit 36 is configured to receive an operation by the player. The display unit 28 is operably coupled to the operation unit 36 and configured to display a first display area 61 and a second display area 63. In one embodiment, the first display area 61 is displayed on the lower display 24 and the second display area 63 is displayed on the upper display 22. In another embodiment, the first and second display areas 61, 63 are displayed on a single display. In one embodiment, the second display area 63 is displayed after the free spins are awarded. In another embodiment, the second display area 63 is displayed during the primary game and the bonus game.

As discussed above, the first display area 61 includes a first plurality of cells 64 arranged in a first grid 60. In one embodiment as shown in FIG. 3A, the cells 64 of the first grid 60 form a plurality of columns 61A, 61B, 61C, 61D, 61E. The second display area 63 includes a second plurality of cells 66 arranged in a second grid 62. In one embodiment, the cells 64 of the second grid 62 form a plurality of columns 63A, 63B, 63C, 63D, 63E.

The control unit 50 is operably coupled to the operation unit 36 and the display unit 28 and is configured to initiate the primary game in response to player operation and to establish an outcome of the primary game. In one embodiment, the primary game is a video slot game, but any type of primary may be utilized. The control unit 50 is being further configured to detect a trigger condition and to responsively establish a number of free games (or spins). The number of free games may be predetermined, set, or may be randomly determined.

For each free game, the control unit 50, randomly selects a plurality of symbols associated with the first display area 61. In one embodiment of the present invention the free games are spins of a video slot game utilizing the first grid 60 of the first display area 61. Each symbol in the plurality of symbols being associated with one of the plurality of cells 64 in the first grid 60. The randomly determined plurality of symbols form an interim outcome. An award may be awarded to the player as a function of the interim outcome and one or more pay lines.

For each interim outcome, the control unit 50 determines of a predetermined symbol has appeared in the interim outcome. In one embodiment, the predetermined symbol is a Wild symbol.

A free game award may be awarded by the control unit 50 after each free game or spin, as a function of the interim outcome, one or more pay lines, and a pay table.

If the predetermined symbol has been detected in the first display area 61, then the occurrence of the predetermined symbol is copied from the first display area 61 to a corresponding cell 66 in the second display area 63. In one embodiment, the corresponding cell 66 in the second display area 63 has the same position in the second grid 62 as the cell 64 in the first grid 60 from which the predetermined symbol is copied. In another embodiment, each cell 66 in the second grid 62 is associated with one of the cells 64 in the first grid 60, however, the association may be predetermined and/or randomly determined. Further, the associated cells 64, 66 may not share the same position within the respective gird 60, 62.

Any copied occurrence of the predetermined symbol in the second display area 63 is retained for each remaining free game or spin (see below). If the corresponding cell 66 in the second display area 63 into which the predetermined symbol is copied is already occupied with an occurrence of the predetermined symbol, then a complementary award may be provided to the player. For example, in one embodiment, the complimentary award may include a predetermined or randomly determined a number of credits. In another embodiment, the complimentary award may include moving a redundant occurrence of the predetermined symbol to an unoccupied cell 66 in the second grid 62. In still another embodiment, the complimentary award includes a progressive jackpot. In an additional embodiment, the complimentary award may include is one or more additional free games or spins. In a further embodiment, the complimentary award may include one or more of: (1) a predetermined or randomly determined a number of credits, (2) moving a redundant occurrence of the predetermined symbol to an unoccupied cell 66 in the second grid 62, (3) a progressive jackpot and/or (4) one or more additional free games or spins.

In one embodiment after a last one of the free games, the game controller 50 provides a secondary bonus game using the second grid area 62. In one embodiment, the control unit 50, in providing the bonus game, randomly selects a symbol for each unoccupied cell 66 in the second display grid 62. In other words, any occurrences of the predetermined symbol in the second grid 62 copied during the free spins are retained for the secondary bonus game. The randomly selected symbol(s) and the copied occurrences of the predetermined symbol form a secondary bonus game outcome. The control unit 50 may award a secondary bonus award to the player as a function of the secondary bonus game outcome, one or more pay lines and a pay table.

In an alternative embodiment the secondary bonus game may be provided more than once. For example, the secondary bonus game may be provided after x number of free games, where x is predetermined or random. In a second alternative embodiment, the secondary bonus game may be provided in response to a trigger condition during the free spins. The trigger condition may be satisfied by, or within, the first grid 60 and/or the second grid or may be a mystery trigger condition.

In one embodiment, the second display area 63 is displayed on the display 28 in response to detection of the trigger condition.

In one embodiment, the primary game is a video slot game. The first grid 60 has a plurality of columns 61A, 61B, 61C, 61D, 61E. Each column 61A, 61B, 61C, 61D, 61E defines a reel of the video slot game. The control unit 50 may be configured select a plurality of symbols to display symbols in the cells 64 of the first grid 60 in a manner to simulate rotating reels. The plurality of symbols being displayed in the cells 64 of the first grid 60 when the simulated rotating reels are stopped. Each column 61A, 61B, 61C, 61D, 61E has an associated reel strip 71-75. Each reel strip 71-75 includes a plurality of symbol positions populated with a respective symbol. In one embodiment, each of the free spins or game is a video slot game, provided in a similar manner.

In one embodiment, the secondary bonus game is a video slot game. The second grid 62 has a plurality of columns 63A, 63B, 63C, 63D, 63E. Each column 63A, 63B, 63C, 63D, 63E defines a reel of the video slot game. The control unit 50 may be configured to select a plurality of symbols to display symbols in the cells 66 of the second grid 62 in a manner to simulate rotating reels. The plurality of symbols being displayed in the cells 66 of the second grid 66 when the simulated rotating reels are stopped. Each column 63A, 63B, 63C, 63D, 63E has an associated reel strip (not shown). Each reel strip (not shown) includes a plurality of symbol positions populated with a respective symbol. It should be noted that the occurrences of the predetermined symbol copied from the first grid 60 during the free spins are retained during the secondary bonus game. Thus, the symbols on the reel strip are not visible in the cells 66 containing a copied symbol.

In one embodiment, the second display area 63 is displayed over or overlaid the first display area 61.

In another embodiment, the second display area 63 is displayed in response to the trigger condition being detected during the primary game.

In another embodiment, the second display area 63 is displayed after the last free game or spin has been completed. One or more indicia may be displayed relative to the first display area 62 as a function of accumulated predetermined symbols.

Figure 7A:
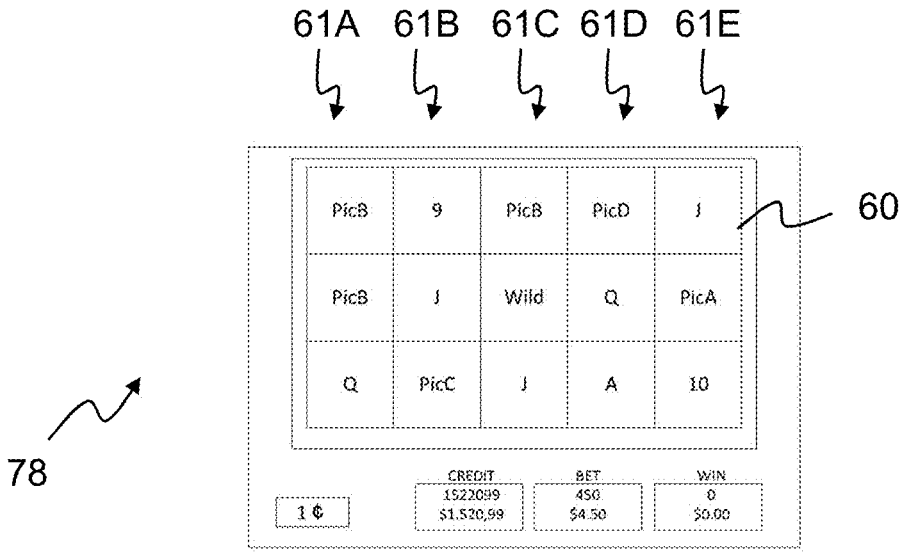
FIGS. 7A-7D are diagrammatic illustrations of the first display area of the gaming machine in FIG. 1 during a primary game, according to an embodiment of the present invention.
Figure 7B:
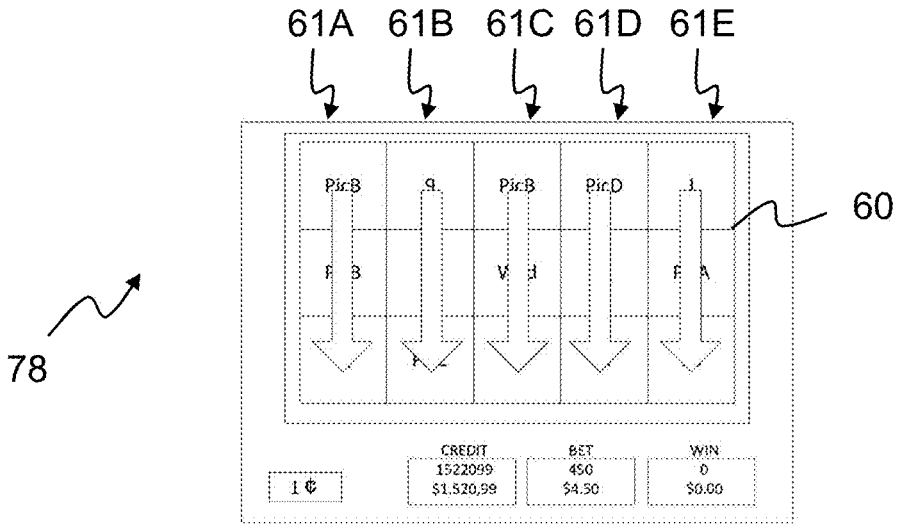
Figure 7C:
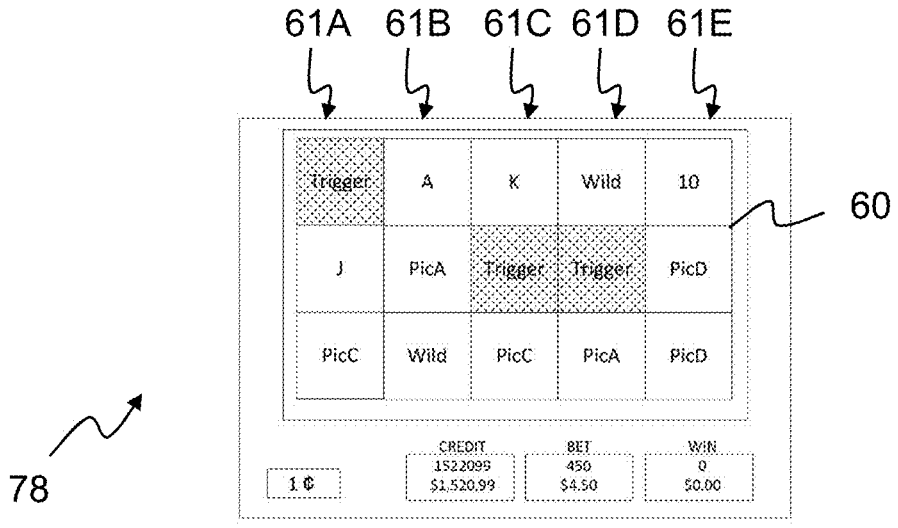

With particular reference to FIGS. 7A-70, a display screen 78[sk3][JY4] of a first instance of a game according to an embodiment of the present invention will be discussed. As mentioned above, the present invention may provide a main game and a bonus game. The main game may be a video slot game, and may be played on the first grid 60. As shown in FIG. 7A, in the first embodiment, a 3×5 grid of cells 64 may be used. The grid 60 in FIG. 7A shows the outcome of the previous game. In the display screen 78[sk5][JY6] of FIG. 7B, the reel strips 71-75 in the columns 6A-61E start spinning. In one embodiment, the reels 71-75 stop spinning from left to right to display an outcome of the primary game (see FIG. 7C).

Figure 7D:
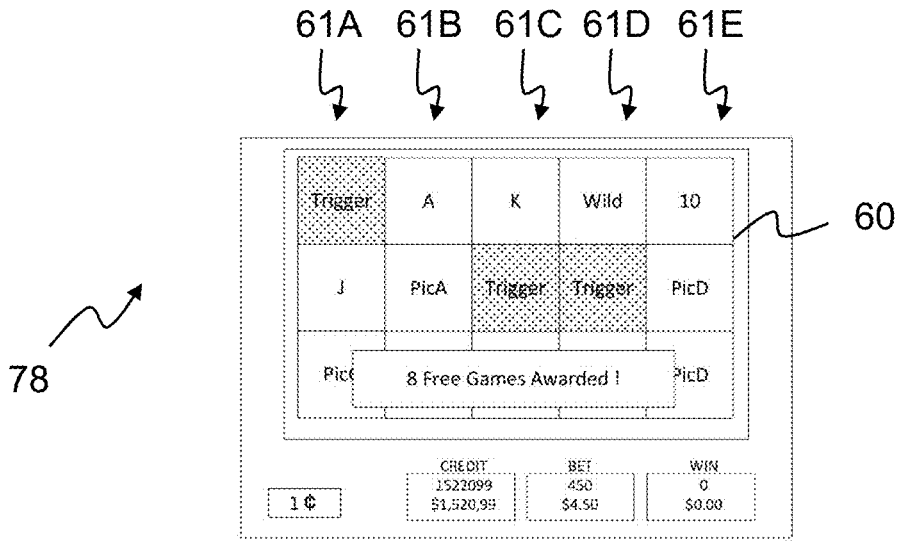

During the primary game, if a trigger condition is detected, then a bonus game is played. In the illustrated embodiment, the bonus game is triggered if a predetermined number of a trigger symbol appear in the outcome of the primary game. If the trigger condition is detected, then the player is alerted to the triggering of the bonus game (see FIG. 7D). In the illustrated embodiment, the bonus game includes the awarding a number of free games or spins. As shown in FIG. 7D, in the illustrated embodiment, 8 games have been awarded to the player.

Figure 7E:
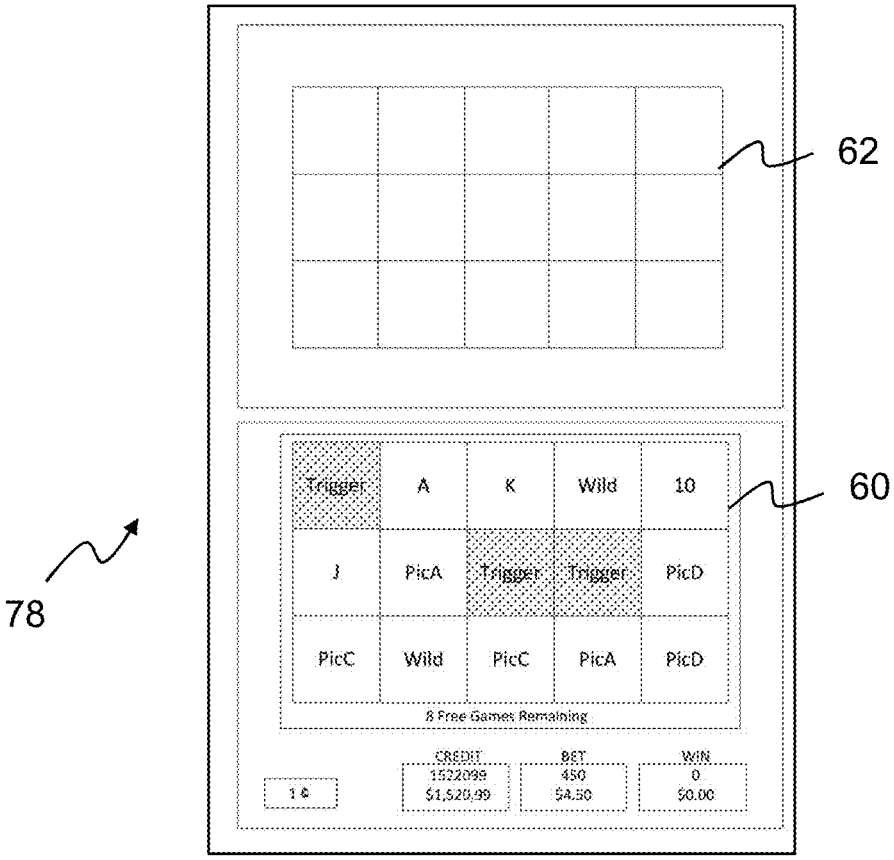
FIGS. 7E-7P are diagrammatic illustrations of the first and second display areas of the gaming machine in FIG. 1 during a bonus or feature game, according to an embodiment of the present invention.
Figure 7F:
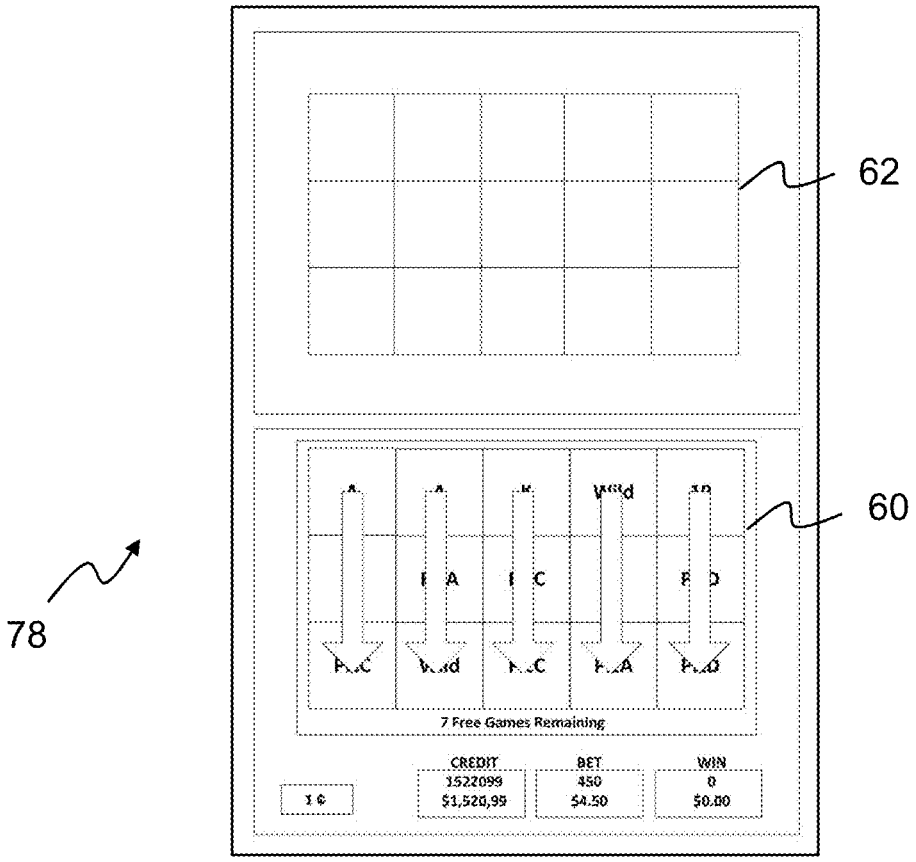
Figure 7G:
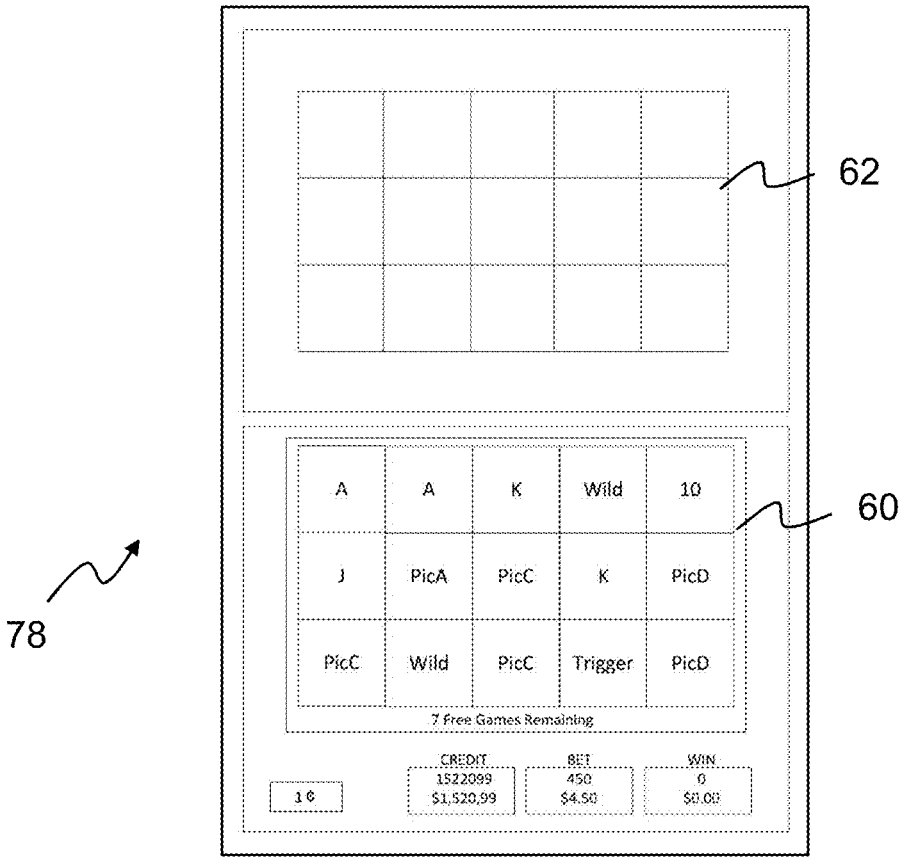
Figure 7H:
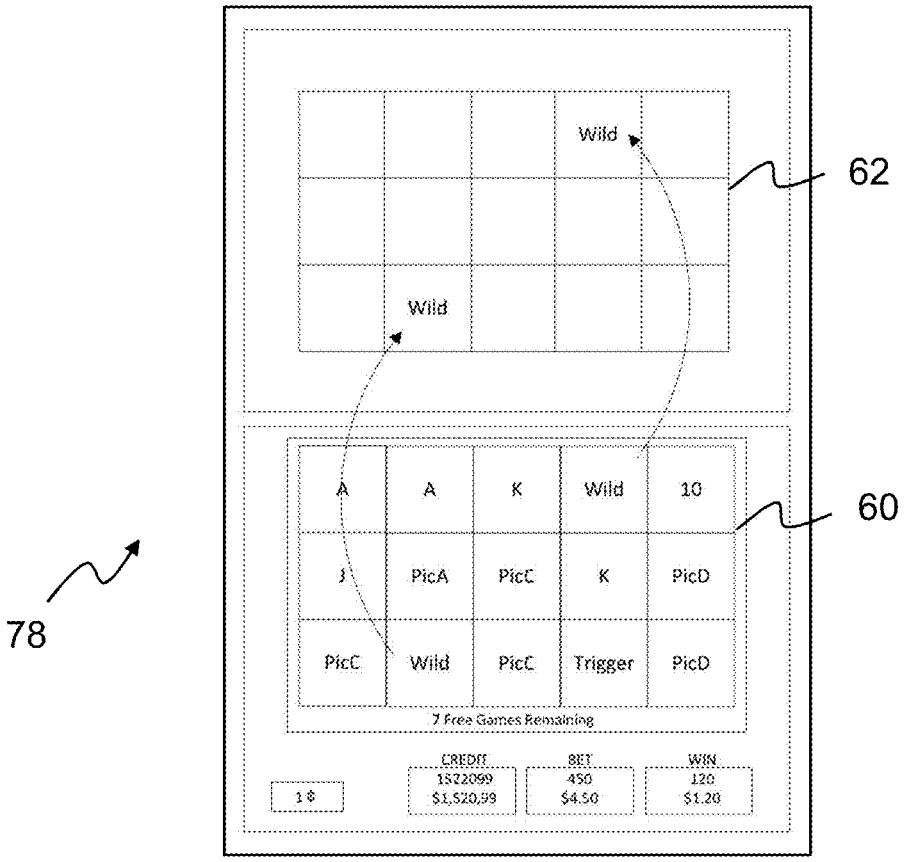

With reference to FIG. 7E, once the bonus game has been entered or triggered, the second grid 62 is displayed in the second display area 63. After the second grid 62 is displayed, the first free game is started. In one embodiment, the free games are video slot games displayed in the first display area 61. The reel strips used in the free games may be the same or different from the reel strips 71-75 used in the primary game. The reels defined by the columns 61A-61E of the first grid 60 are stopped (see FIG. 7G). The displayed symbols in the first grid 60 form an interim outcome. Any Wild symbols in the interim outcome are transferred or copied to the second grid 62 (see FIG. 7H).

The occurrences of the predetermined symbol in the interim outcome are transferred to associated cells 66 in the second grid 62 (see above). In the illustrated embodiment the occurrences of the predetermined symbol are transferred to corresponding cells. As shown, the Wild symbol in the first row, fourth column of the grid 60 is copied to the cell 66 in the first row, fourth column of the second grid 62. The Wild symbol in the third row, second column of the first grid 60 is copied to the cell 66 in the third row, second column in the second grid 62.

Figure 7I:
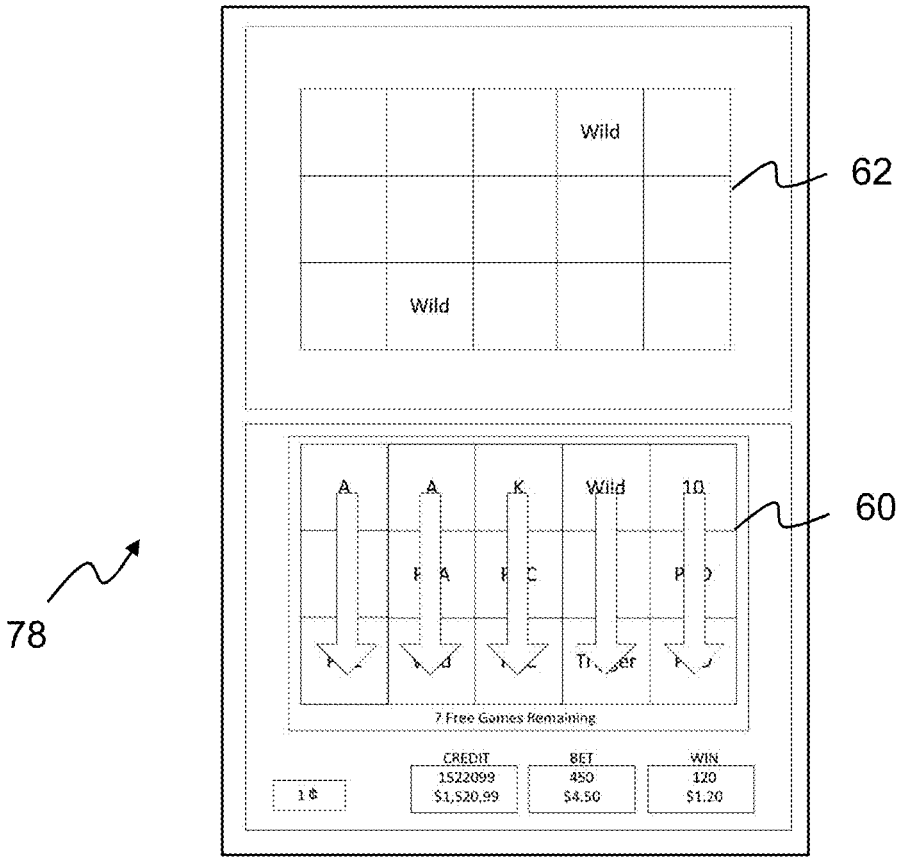
Figure 7J:
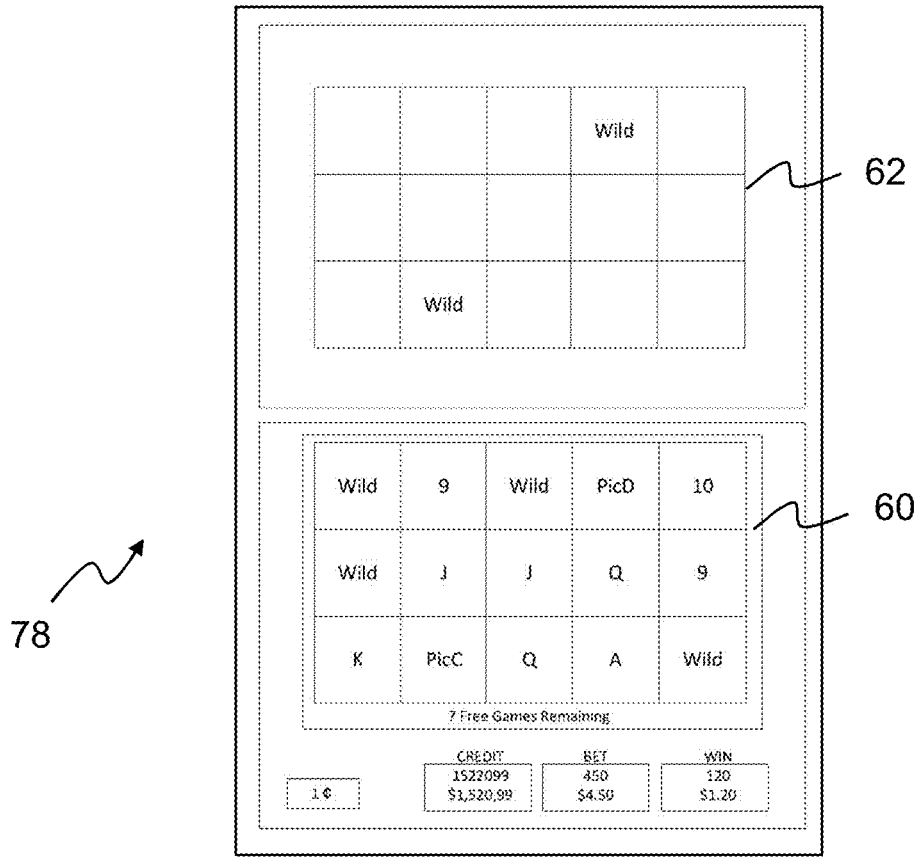
Figure 7K:
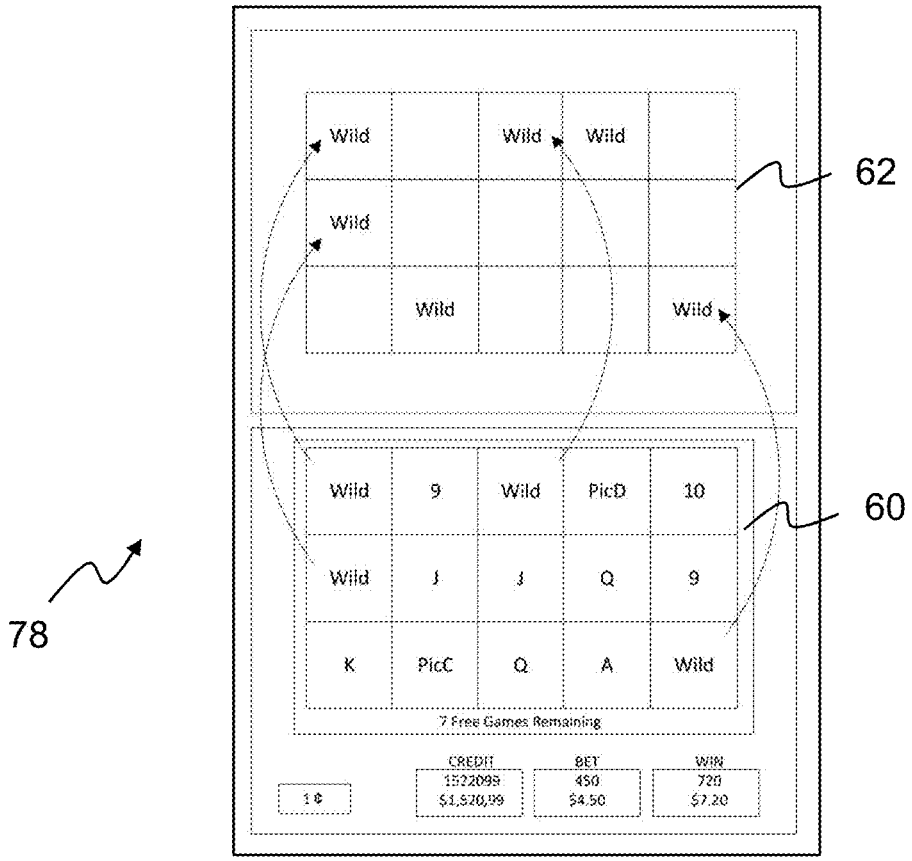

In FIG. 7I, the second free spin is started while the copied occurrences of the predetermined symbol in the second grid 62 are retained. The reels are stopped in FIG. 7J to display a second interim outcome. The second interim outcome includes 4 Wild symbols. The occurrences of the 4 Wild symbols are copied into the corresponding cells 66 in the second grid 62 (see FIG. 7K).

Figure 7L:
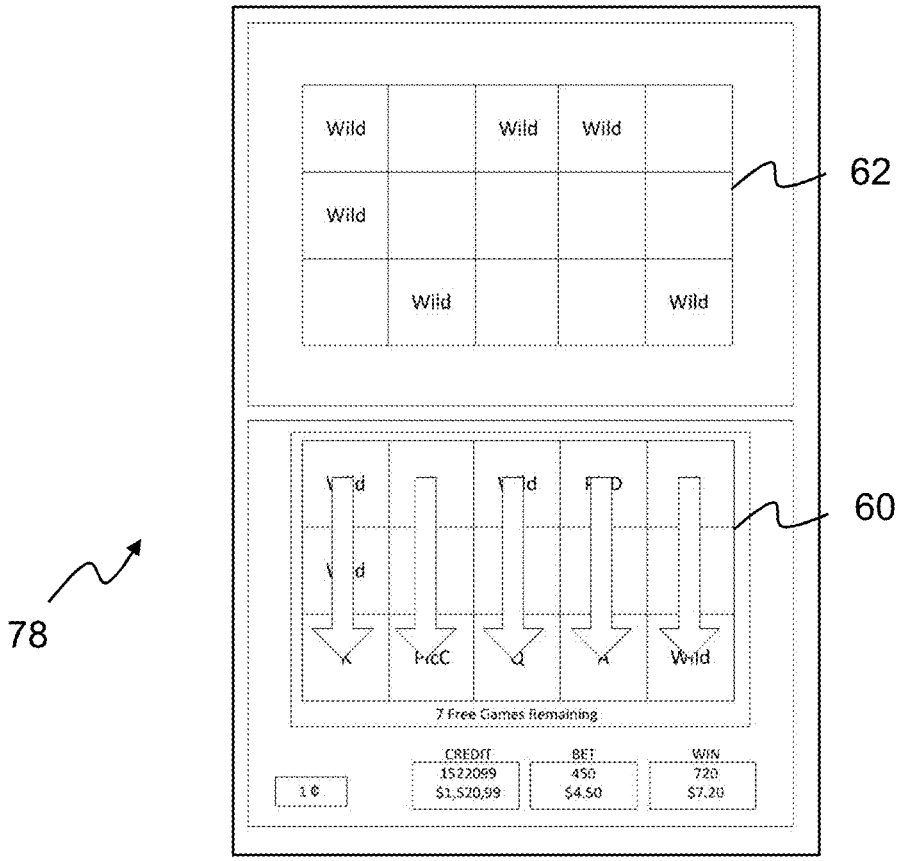

In FIG. 7L, the third free spin has started while the copied occurrences of the predetermined symbol in the second grid 62 from both the first and second free spins are retained.

Figure 7M:
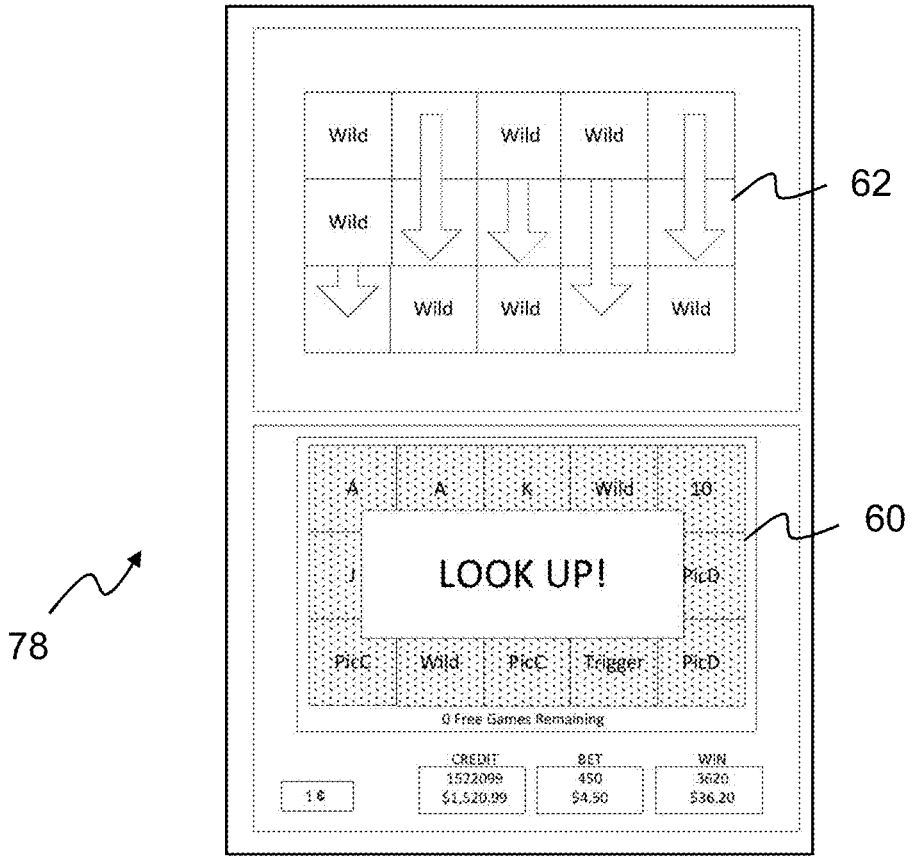
Figure 7N:
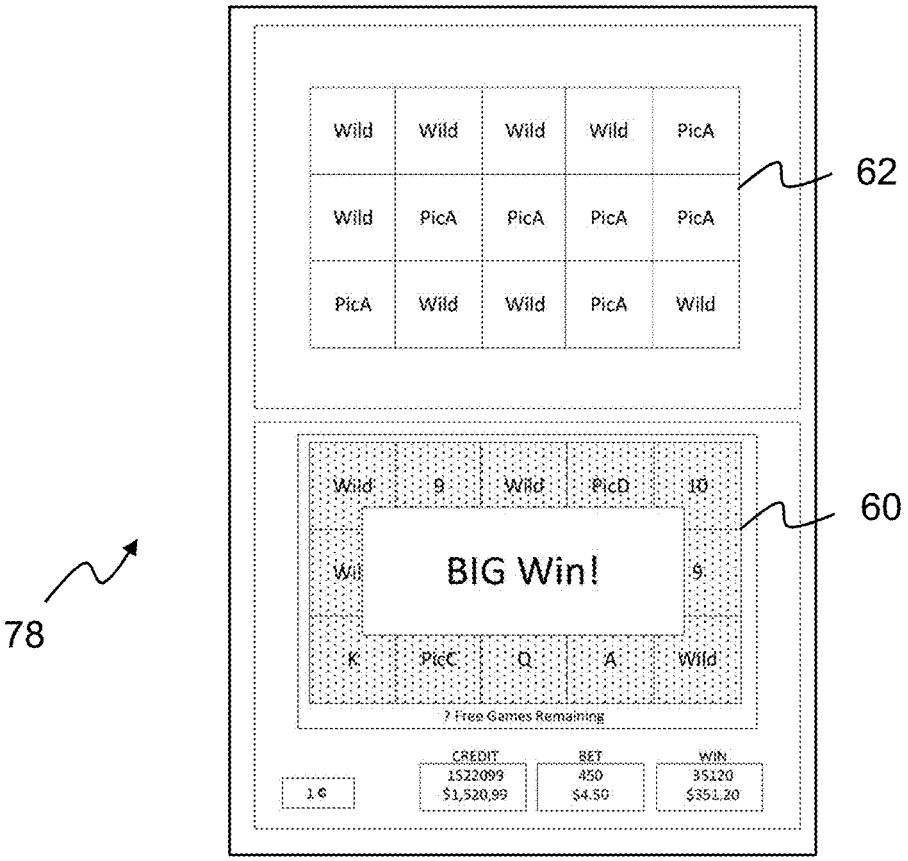

After all of the free spins have completed, a secondary bonus game in the form of an extra spin on the second grid 62 is provided. Extra reels with associated reel strips are assigned to each column 63A, 63B, 63C, 63D, 63E in the second grid 62. As shown in FIG. 7M, the extra reels begin spinning, however, the copied occurrences of the predetermined symbol from the free spins are retained and appear over the spinning reels. In FIG. 7N, the extra reels stop spinning. The outcome of the secondary bonus game includes the copied occurrences on the predetermined symbol in the second grid 62 and any visible symbols from the extra reels. A secondary bonus game award may be paid to the player as a function of the secondary bonus game outcome, one or more pay lines, and a pay table.

Figure 7O:
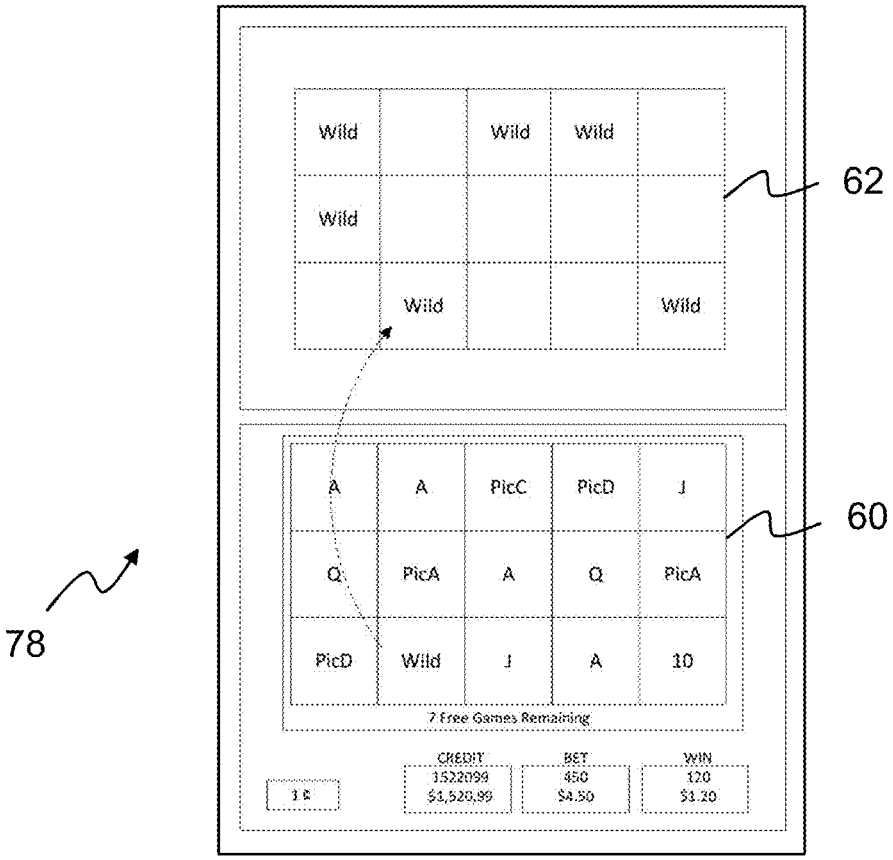
Figure 7P:
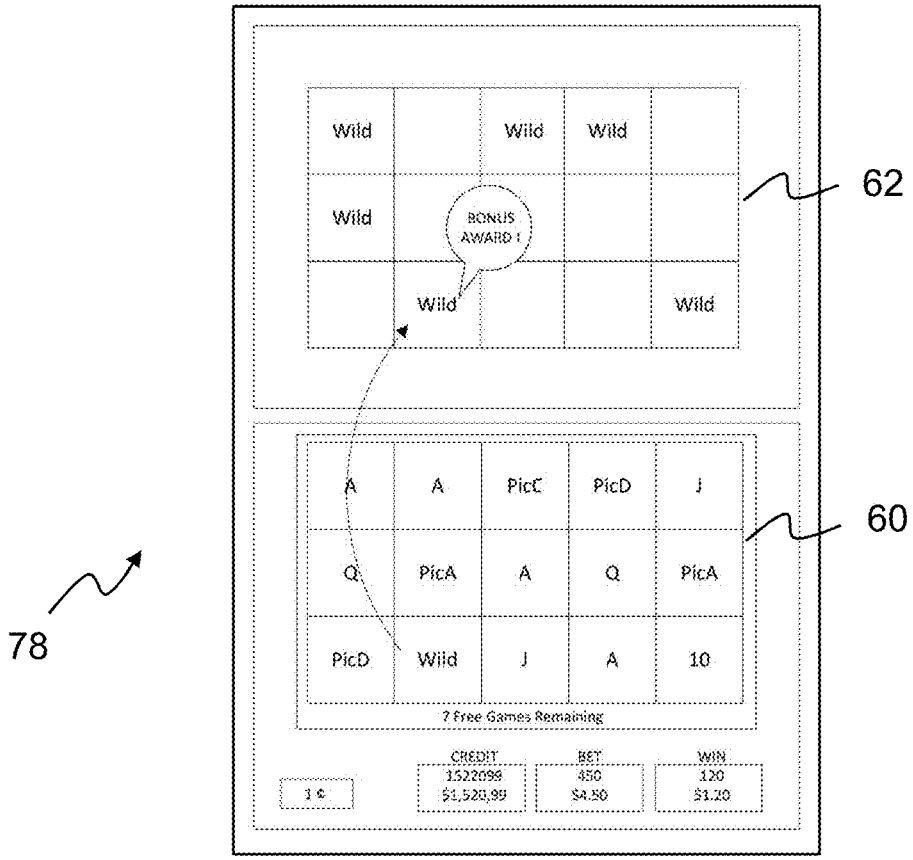
Figure 8A:
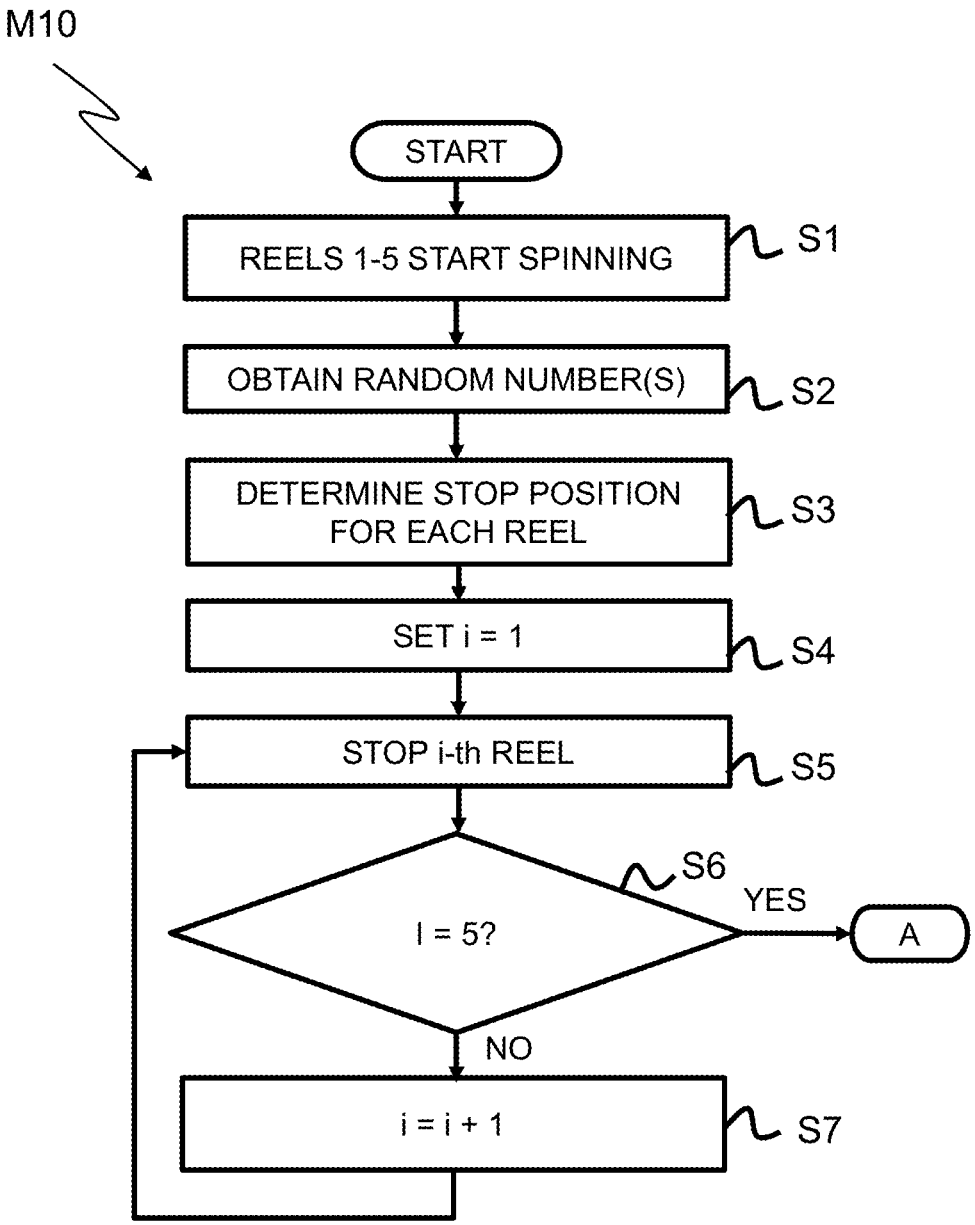
FIGS. 8A-8B are first and second portions of a flow chart describing the operation of the gaming machine during a primary game, according to one embodiment of the present invention.
Figure 8B:
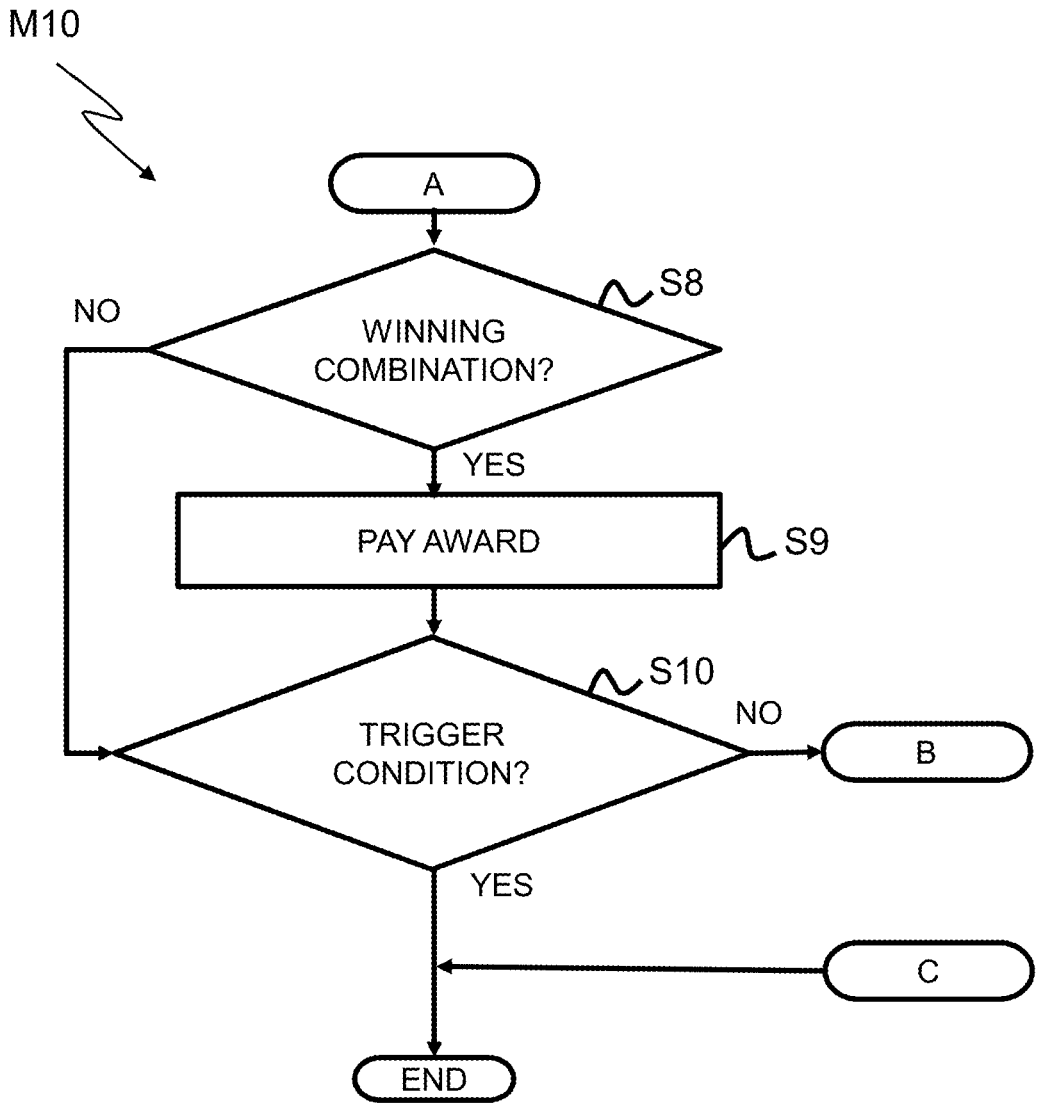

In another aspect of the present invention, during the free spins if the associated cell 66 in the second grid 62 into which an occurrence of the predetermined symbol is to be copied already contains a predetermined symbol, then a complimentary (or bonus) award may be provided. For instance, with respect to FIG. 7O the interim outcome of a free spin is shown in the first grid 60. The interim outcome includes a Wild symbol in the third row, second column. However, the second grid 62 already contains a Wild symbol in the corresponding cell 66 therefore the player is provided with a complimentary or bonus award (see FIG. 7P). As discussed above, the complimentary award may include one or more of: (1) a predetermined or randomly determined a number of credits, (2) moving a redundant occurrence of the predetermined symbol to an unoccupied cell 66 in the second grid 62, (3) a progressive jackpot, (4) is one or more additional free games or spins, and/or any suitable award.

In another aspect of the invention, a control method for a gaming machine 10 provides a game to a player. The gaming machine 10 includes an operation unit 36, a display unit 28, and a control unit 50. The operation unit 36 is configured to receive an operation of a player. The display unit 28 is operably coupled to the operation unit 36 and is configured to display a first display area 61 and a second display area 63. The first display area 61 includes a first plurality of cells 64 arranged in a first grid 60. The second display area 63 includes a second plurality of cells 66 arranged in a second grid 62. The control unit 50 is operably coupled to the operation unit 36 and the display unit 28. The control method includes the steps of initiating a primary game in response to player operation and establishing an outcome of the primary game, detecting a trigger condition and responsively establishing a number of free games. The control method, in providing each free games, includes the step of randomly selecting a plurality of symbols associated with the first display area. Each symbol in the plurality of symbols being associated with one of the plurality of cells in the first grid. The plurality of symbols forming an interim outcome.

During each free game, the method also includes the steps of detecting an occurrence of a predetermined symbol in the first display area 61 and copying the occurrence of a predetermined symbol from the first display area 61 to a corresponding cell in the second display area 63. The occurrence of the predetermined symbol in the first display area 61 is associated with one of the cells of the first display area 61. Any copied occurrence of the predetermined symbol in the second display area 63 is retained for each remaining free game. A complementary award is provided to the player if the corresponding cell in the second display area 63 is already occupied with an occurrence of the predetermined symbol. After a last one of the free games, a secondary bonus game is provided using the second grid area 62. The control method, in providing the secondary bonus game, further includes the step of randomly selecting a symbol for each unoccupied cell in the second display grid 62. The randomly selected symbol(s) and the copied occurrences of the predetermined symbol form a secondary bonus game outcome.

With reference to FIGS. 8A-8B and 9A-9D, an exemplary flow diagram of a method M10 for operating the gaming machine 10 is shown, according to an embodiment of the present invention. In a first step S1, the reels start spinning. In a second step S2, a series of random numbers are generated. In the illustrated embodiment, the random numbers represent the stop position of each reel. In a third step S3, the stop position of each reel is determined as a function of the respective random number.

In a fourth step S4, a counter, i, is set to 1. In a fifth step S5, the i-th reel is stopped. In a sixth step S6, if the last reel has not been reached, then the method M10 proceeds to a seventh step S7. Otherwise, the method M10 proceeds to an eighth step S8. In the seventh step S7, i is incremented and the method M10 proceeds back to the fifth step S5.

The symbols on the reels 71-75 displayed in the first grid 60 form the primary game outcome. In the eighth step S8, the primary game outcome is evaluated and if a winning outcome is detected then a primary game award is paid to the player in a ninth step S9 and the method proceeds to a tenth step S10. If, in the eighth step S8, a winning combination is not detected in the primary game outcome, then the method M10 proceeds to the tenth step S10.

In the tenth step S10, if a bonus game trigger is detected, then a bonus game method M20 (shown in FIGS. 9A-9D) is performed. Otherwise, the method M10 ends.

With specific reference to FIGS. 9A-9D, a method M20 for providing a bonus game according to an embodiment of the present invention is provided. In an eleventh step S11, the second grid 62 is displayed in the second display area 63. In a twelfth step S12, the free game(s) are started, i.e., the reels start spinning. In a thirteenth step S13, a series of random numbers are generated. In the illustrated embodiment, the random numbers represent the stop position of each reel. In a fourteenth step S14, the stop position of each reel is determined as a function of the respective random number.

In a fifteenth step S15, a counter, i, is set to 1. In a sixteenth step S16, the i-th reel is stopped. In a seventeenth step S17, if the last reel has not been reached, then the method M20 proceeds to an eighteenth step S18. Otherwise, the method M20 proceeds to a nineteenth step S19. In the eighteenth step S18, i is incremented and the method M20 returns to the sixteenth step S16.

In the nineteenth step S19, if one or more Wild symbols appear in the interim outcome, i.e., the outcome of the free spin, then the method M20 proceeds to a twentieth step S20. Otherwise, the method M20 proceeds to a twenty-fifth step S25.

In the twentieth step S20, any Wild symbol(s) in the interim outcome are copied to the second grid 62. If the corresponding position or cell on the second grid 62 already contains a Wild symbol, then the method M20 proceeds to a twenty-third step S23. Otherwise, the method M20 proceeds to a twenty-second step S22.

In the twenty-second step S22, the Wild symbol is retained in the original position in the second grid 62 and the method proceeds to the twenty-fifth step S25.

In the twenty-third step S23 a complimentary award is randomly determined and the complimentary award is paid to the player in a twenty-fourth step S24. The complimentary award is discussed in additional detail above.

In the twenty-fifth step S25, the interim outcome, i.e., the outcome of the free spin is evaluated. If the interim outcome contains a winning outcome, then the method M20 proceeds to a twenty-sixth step S26. Otherwise, the method M20 proceeds to a twenty-ninth step S29.

In the twenty-sixth step S26, the player is paid an award based on the winning combination, a pay line and a pay table.

In a twenty-seventh step S27, if a re-trigger condition has occurred, e.g., the appearance of a predetermined number of trigger symbols in the interim outcome, then one or more free spins may be added or awarded in a twenty-eighth step S28.

Figure 9A:
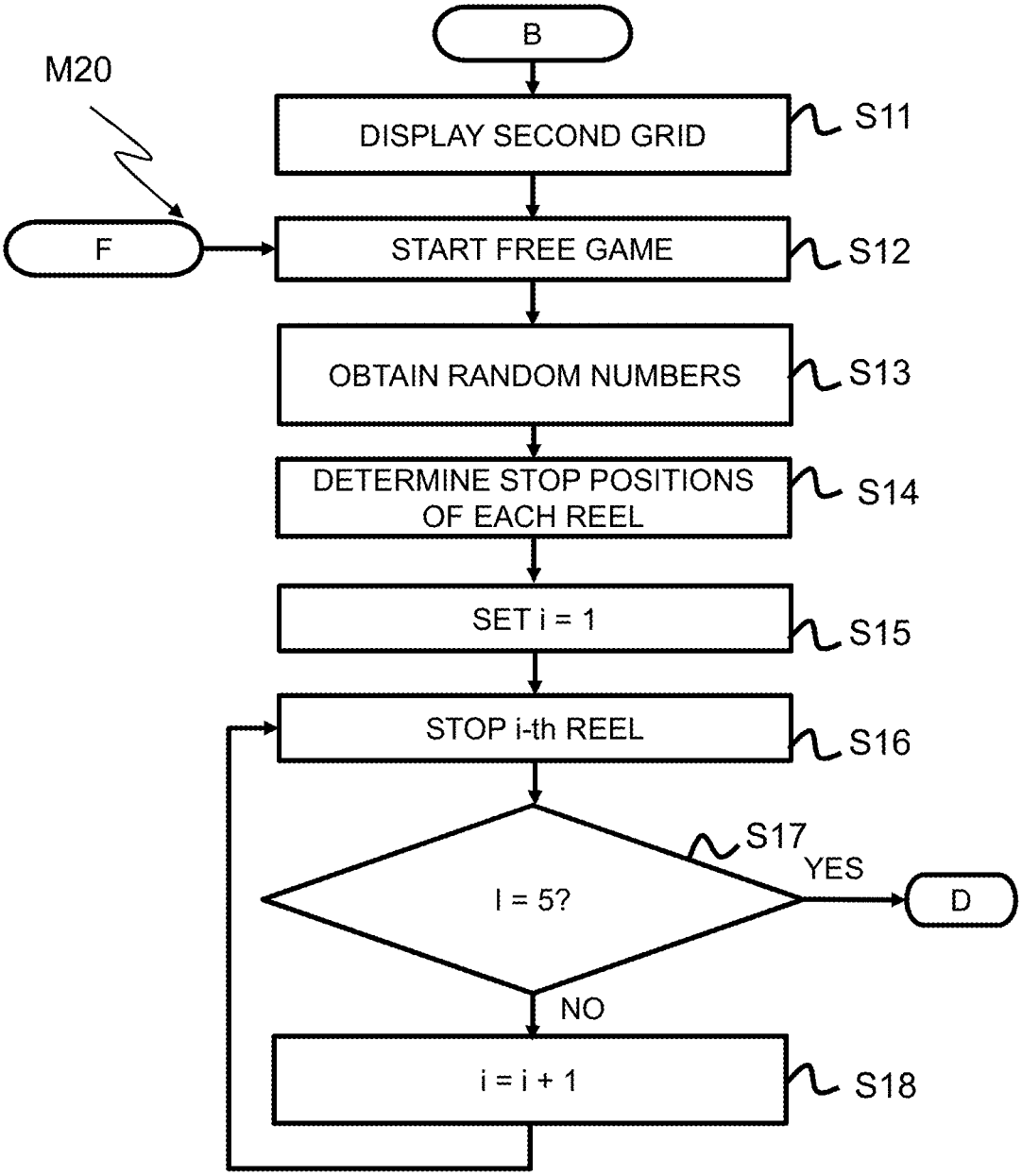
FIGS. 9A-9D are portions of a flow chart describing the operation of the gaming machine during a bonus or feature game, according to an embodiment of the present invention.
Figure 9B:
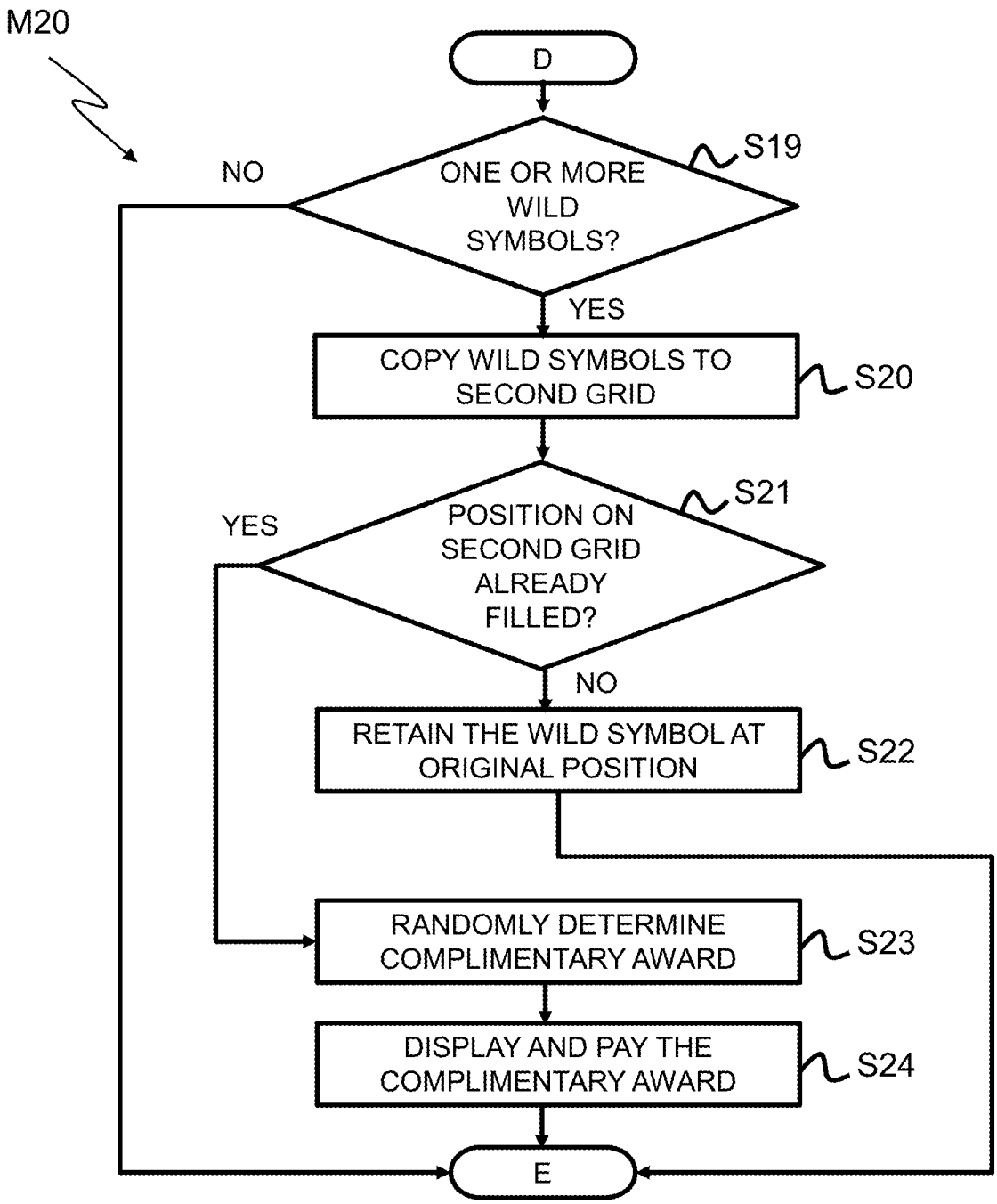
Figure 9C:
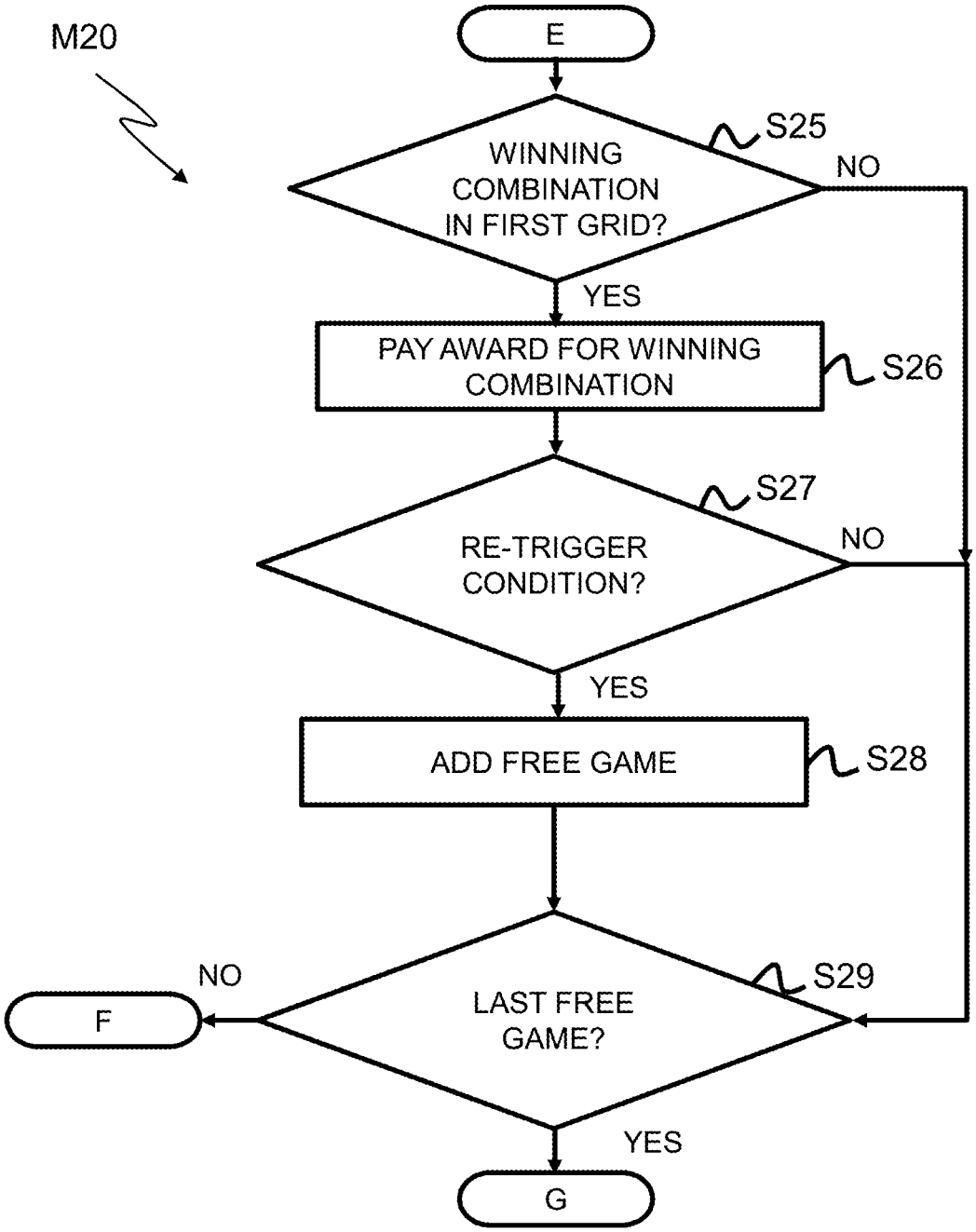
Figure 9D:
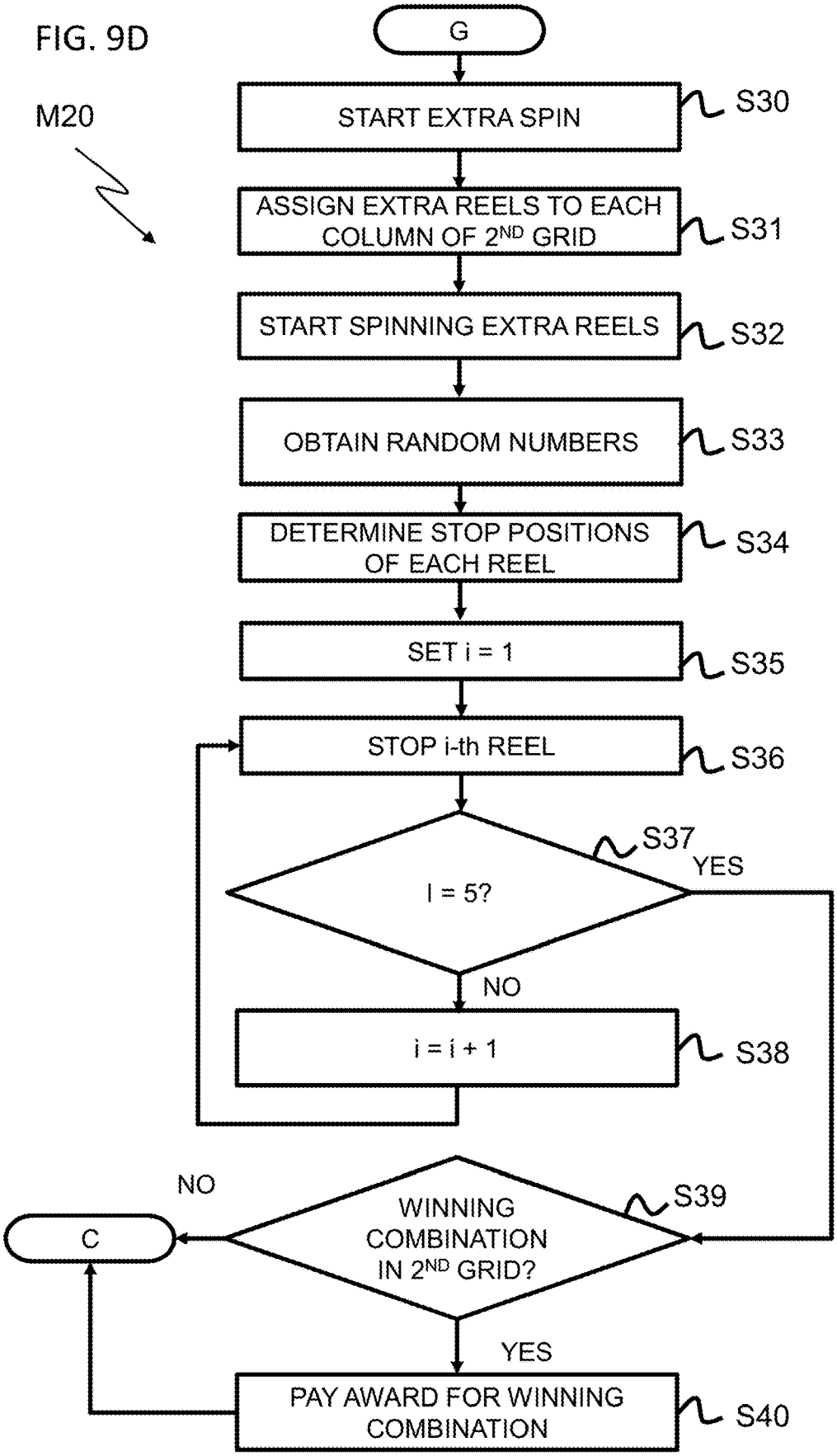

In the twenty-ninth step S29, if all of the free games have been provided then the method proceeds to a thirtieth step S30. Otherwise, the method M20 returns to the twelfth step S12. In FIG. 9D, the extra spin on the second grid 62 is performed. In the thirtieth step S30, the extra spin is started. In a thirty-first step S31, an extra reel is assigned to each column of the second grid 62.

In a thirty-second step S32, the extra reels start spinning. In a thirty-third step S33, a series of random numbers are generated. In the illustrated embodiment, the random numbers represent the stop position of each reel. In a thirty-fourth step S34, the stop position of each reel is determined as a function of the respective random number.

In a thirty-fifth step S35, a counter, i, is set to 1. In a thirty-sixth step S36, the i-th reel is stopped. In a thirty-seventh step S37, if the last reel has not been reached, then the method M20 proceeds to a thirty-eighth S38. Otherwise, the method M20 proceeds to a thirty-ninth step S39.

In the thirty-eighth step S38, i is incremented and the method M20 proceeds back to the thirty-sixth step S36. The outcome of the extra spin includes any copied occurrences of the predetermined symbol, i.e., the Wild symbol, and any visible symbols from the extra reels. In the thirty-ninth step S39, the outcome of the extra spin is evaluated. If the outcome of the extra spin contained a winning combination, then the method M20 proceeds to a fortieth step S40. Otherwise, the method M20 ends.

In the fortieth step S40, a (secondary bonus award) is paid based on the winning combination, one or more pay lines, and a pay table. Thereafter, the method M20 ends.

In another aspect of the present invention, as discussed above, with reference to FIGS. 10A-10C and 11A-11C, the second grid 62 may be displayed over or on top of the first grid 62 and may be invisible by the player.

Figure 10A:
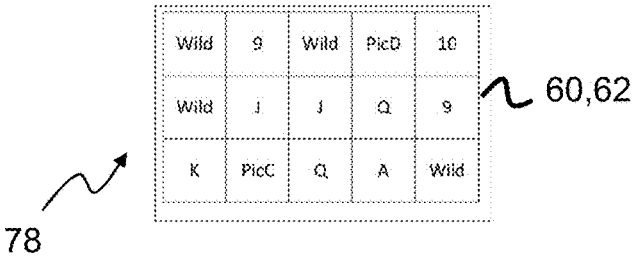
FIGS. 10A-10C are diagrammatic illustrations of the first and second grids during a bonus feature game according to an alternative embodiment of the present invention.
Figure 10B:
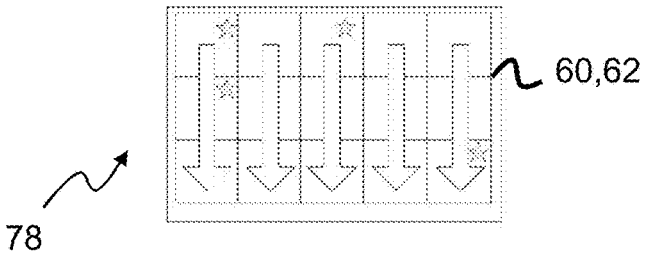
Figure 10C:
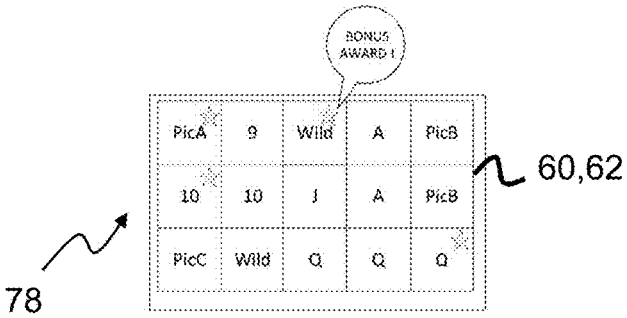

With specific reference to FIGS. 10A-10C, in one embodiment the second grid 62 is utilized during the bonus game, i.e., the free spins. In this embodiment, the first grid and the second grid are laid to overlap each other. During the free spins, the Wild symbols are accumulated in the second grid 62 at the corresponding position in the first grid 60. The cell 66 of the second grid 62 in which the copied symbol is located is indicated by separate indicia, shown as a small star in the upper right corner of such cells 66. When a redundant symbol is accumulated in the same cell 66 during the free spins, the complimentary award is signaled by a "bonus award" indicia, as shown in FIG. 10C. And after a last spin of the free games, the separate indicia returns to the Wild symbol at the same cell 66 and the second bonus game may be provided as described in above.

Figure 11A:
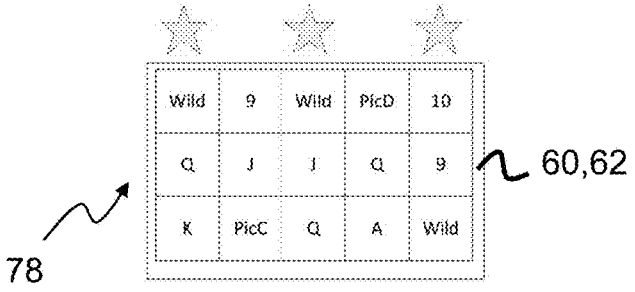
FIGS. 11A-11C are diagrammatic illustrations of the first and second grids during a bonus feature game according to a second alternative embodiment of the present invention.
Figure 11B:
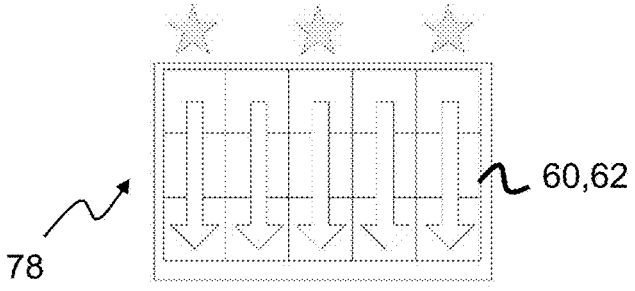
Figure 11C:
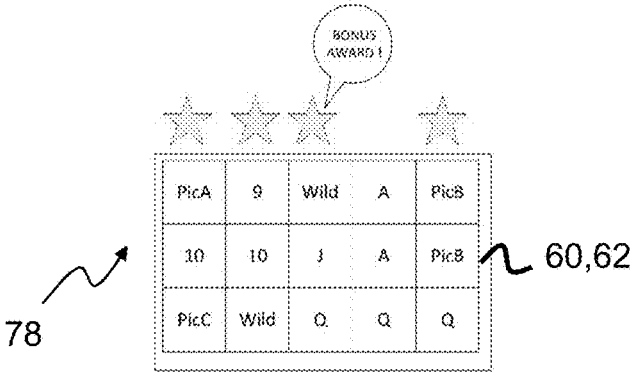

With specific reference to FIGS. 11A-11C, in one embodiment the second grid 62 is utilized during the bonus game, i.e., the free spins. In this embodiment, the second grid 62 is placed upward of the first grid 60 and each cell 66 of the second grid 62 corresponds to a respective column of the first grid 60. During the free spins, the Wild symbols are accumulated in the second grid 62 at the corresponding position in the first grid 60. The cell 66 of the second grid 62 in which the copied symbol is located is indicated by separate indicia, shown as a star above the respective column. When a redundant symbol is accumulated in the same cell 66 during the free spins, the complimentary award is signaled by a "bonus award" indicia, as shown in FIG. 11C.

Next, is a description of a program of the gaming machine 10 for operating one or a plurality of computers as the control unit 50. The gaming machine 10 stores the program in the memory, and can execute the program. The gaming machine 10 can access the program stored in the memory and can operate as the gaming machine 10 of the present embodiment by the program.

Further, the program according to the embodiment may be provided through a network or stored in a recording medium. Recording media such as a floppy (registered trademark) disk, CD-ROM, DVD, or ROM and the like, or semiconductor memory and the like are exemplified as a recording medium. In this case, a program stored in the memory uses a reading device inside the gaming machine 10 such as a floppy (registered trademark) disk drive device, CD-ROM drive device, and DVD drive device and the like.

The embodiments of the present invention are described above, but the present invention is not limited to such an embodiment, a variety of variations are possible.

In such an embodiment, a gaming machine providing a game in the form of a slot machine is described, but this is not limited thereto, and a game in the state of poker, a video card game called black jack, bingo, keno, a wheel game and the like may be provided. Further, it is possible to apply the present invention to a pachinko machine or a pachinko slot machine.

In one embodiment, referring to FIGS. 1A and 1B, the control panel 26 includes a plurality of user input devices that may include an acceptor device which accepts media associated with a monetary value to establish a credit balance, a validator configured to identify the physical media, a cash-out button actuatable to cause an initiation of a payout associated with the credit balance. The acceptor device may include a touchscreen display associated with the display unit 28 and/or the player tracking unit 57, the paper money/ticket identification unit 42, the operation unit 36, the player tracking unit 57, a coin slot, a ticket in ticket out (TITO) system, a bill acceptor, and/or any suitable device that enables the gaming machine 10 to receive media associated with a monetary value and establish a credit balance for use in playing the gaming machine 10. In one embodiment, the acceptor device may be configured to receive physical media such as, for example, a coin, a medal, a ticket, a card, a boll, currency, and/or any suitable physical media that enables the gaming machine 10 to function as described herein. The acceptor device may also be configured to accept virtual media such as, for example, a player tracking account, a virtual credit balance, reward points, gaming credits, bonus points, and/or any suitable virtual media that enables the gaming machine 10 to function as described herein. For example, in one embodiment, the coin slot may include an opening that is configured to receive coins and/or tokens deposited by the player into the gaming machine 10. The control unit 50 converts a value of the coins and/or tokens to a corresponding amount of gaming credits that are used by the player to wager on games played on the gaming machine 10. The bill acceptor may include an input and output device that is configured to accept a bill, a ticket, and/or a cash card into the bill acceptor to enable an amount of gaming credits associated with a monetary value of the bills, ticket, and/or cash card to be credited to the gaming machine 10. In one embodiment, the bill acceptor also includes a printer (not shown) that is configured to dispense a printed voucher ticket that includes information indicative of an amount of credits and/or money paid out to the player by the gaming machine 10 during a gaming session. The voucher ticket may be used at other gaming devices, or redeemed for cash, and/or other items as part of a casino cashless system.

In the embodiment, determining the stop position of each reel is described as consecutively acquiring a random number that is used respectively, but the acquisition procedure of the random number is not limited to this. For example, when the game starts, the control unit 50 acquires these random numbers in a batch, and each random number may be stored in the storage area of the non-erasing memory 53 or the storage 54 when power failure occurs. In this type of situation, even when a power failure and the like occurs during a game, because the control unit 50 acquired the random number from the memory 53 or the storage 54 when the game started before the power failure occurred, when resuming the game after recovering from a power failure, the progress of the game can be reproduced. For example, when a game result obtaining a high payout is formed right before a power failure occurs, the player will be greatly dissatisfied if the progress of the game is not similar after recovering from a power failure. However, as mentioned above when the game starts all of the random numbers are acquired in a batch, and by saving these random numbers in the memory 53 or the storage 54, such great dissatisfaction can be avoided for the player because the progress of a game similar to before a power failure occurred can be reproduced after recovering from a power failure.

In another embodiment, the player may initiate a game through actuation of a spin button (or other button). After initiation of the game, the control unit 50 randomly determines the step position of all reels. The control unit 50 may perform the check for the trigger condition before the reels stop spinning, and thus has already determined the outcome of the game. However, the control unit 50 displays the outcome of the game in a step by step process as discussed above. Further, if the trigger condition has occurred with respect to the columns in the left plurality of columns, the check and evaluation of the interim outcome with respect to the columns in the right plurality of columns should be performed in certain embodiments. For example, if the bonus game is provided that is triggered based on the interim outcome, the interim outcome must be established to perform such an evaluation.

Further, in the embodiment, a bill/ticket is displayed as game value, and received by these bill/ticket identification devices (32, 55), and a form where a ticket is output by a printer unit 34 is described, but the present invention is not limited to this. The game value is a concept including tangible objects such as a coin, bill, coin, medal, ticket, and the like, or electronic data that has a value equivalent to these. For example, a coin is received by the coin accepter, and there may be a form where a coin is paid by a coin hopper. A player is identified and credit that is accumulated in an account on a server is used, there may be a form where credit is paid to an account, information of credit stored in a storage medium of a magnetic card, IC card and the like is read and used, and there may be a form where credit is paid by writing to the storage medium.

Further, in the embodiment when showing a free game provided as a bonus game, a bonus game that uses a different virtual reel strip from a regular game may be provided. Further, there could be a provided a feature game according to a value of the random number acquired during a regular game.

Further, set conditions providing a bonus or feature game are not limited to trigger determination or line determination, for example there may be a configuration providing a bonus game when the bet number surpasses a predetermined value. There could be a configuration providing a bonus game according to a value of the random number acquired during a regular game.

Further, in the embodiment, a form providing a free game for a predetermined number of times as a bonus game is shown, and a bonus game that is not limited to a number of times may be provided. In this situation, there could be a configuration providing a bonus game until an end condition is satisfied, as an end condition is a combination of specified symbols, or a determining bonus game based on a random number.

Exemplary embodiments of a gaming device, a gaming system, and a method of providing an award to a player are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications. For instance, the present invention is applicable to a gaming system which is a combination of a community gaming system and individual gaming devices. In such a case, the individual gaming device and the community gaming device provide feature game cooperatively by providing 2nd display area on the community gaming system and 1st display area on the individual gaming devices et al. And the predetermined symbol is copied from the 1st display area on the individual gaming devices to 2nd display area on the community gaming system and the like.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine for providing a game, comprising:

an operation unit including a plurality of input buttons configured to receive an operation of a player;

a display unit including at least one display device, the at least one display device configured to display computer-generated graphics; and, a control unit operably coupled to the operation unit and the display unit, the control unit including a processor for generating the game on the at least one display device, the processor programmed to display a first display area and a second display area on the at least one display device, the first display area including a first plurality of cells arranged in a first grid, the second display area including a second plurality of cells arranged in a second grid, the processor of the control unit, in response to the operation of the player, being further programmed to initiate the game and to responsively:

randomly select a plurality of symbols associated with the first display area, each symbol in the plurality of symbols being associated with one of the plurality of cells in the first grid, the plurality of symbols forming an interim outcome;

detect an occurrence of a predetermined symbol in the first display area, the occurrence of the predetermined symbol being associated with one of the first plurality of cells of the first display area;

copy the occurrence of the predetermined symbol from the first display area to a corresponding cell in the second display area, wherein a complimentary award is provided to the player if the corresponding cell in the second display area is already occupied with an occurrence of the predetermined symbol, wherein the complimentary award includes moving a redundant occurrence of the predetermined symbol to an unoccupied cell in the second grid; and provide a secondary bonus game using the second grid area including randomly selecting a symbol for each unoccupied cell in the second display grid, wherein the randomly selected symbol(s) and the copied occurrence (s) of the predetermined symbol form a secondary bonus game outcome.

2. The gaming machine, as set forth in claim 1, wherein the control unit is further configured to award a bonus award to the player as a function of the secondary bonus game outcome.

3. The gaming machine, as set forth in claim 2, wherein the control unit is further configured to award a free game award to the player as a function of each interim outcome for each free game.

4. The gaming machine, as set forth in claim 1, wherein the first grid having a plurality of columns, wherein each column defines a reel of the a slot game, wherein the processor is programmed to select the plurality of symbols to display in the first plurality of cells of the first grid in a manner to simulate rotating reels, the plurality of symbols being displayed in the first plurality of cells of the first grid when the simulated rotating reels are stopped.

5. The gaming machine, as set forth in claim 4, wherein each column has an associated reel strip, each reel strip including a plurality of symbol positions populated with a respective symbol.

6. The gaming machine, as set forth in claim 5, wherein the secondary bonus game is a video slot game.

7. The gaming machine, as set forth in claim 1, wherein the predetermined symbol is a wild symbol.

8. The gaming machine, set forth in claim 1, wherein the complimentary award includes a number of credits.

9. The gaming machine, as set forth in claim 8, wherein the number of credits is randomly determined.

10. The gaming machine, as set forth in claim 1, wherein the complimentary award includes a progressive jackpot.

11. The gaming machine, as set forth in claim 1, wherein the complimentary award includes one or more free games.

12. The gaming machine, as set forth in claim 1, wherein the second display area is displayed over the first display area.

13. A control method for providing a game to a player using a gaming machine, the gaming machine including an operation unit, a display unit, and a control unit, the operation unit including a plurality of input buttons being configured to receive an operation of a player, the display unit including at least one display device, the at least one display device configured to display computer-generated graphics, the control unit including a processor for generating the game on the at least one display device, the processor operably coupled to the operation unit and the display unit, the control method including the processor performing the steps of:

displaying a first display area and a second display area on the at least one display device, the first display area including a first plurality of cells arranged in a first grid, the second display area including a second plurality of cells arranged in a second grid;

initiating the game in response to operation of the player;

randomly selecting a plurality of symbols associated with the first display area, each symbol in the plurality of symbols being associated with one of the plurality of cells in the first grid, the plurality of symbols forming an interim outcome;

detecting an occurrence of a predetermined symbol in the first display area, the occurrence of the predetermined symbol being associated with one of the first plurality of cells of the first display area;

copying the occurrence of the predetermined symbol from the first display area to a corresponding cell in the second display area, wherein a complimentary award is provided to the player if the corresponding cell in the second display area is already occupied with an occurrence of the predetermined symbol, wherein the complimentary award includes moving a redundant occurrence of the predetermined symbol to an unoccupied cell in the second grid; and providing a secondary bonus game using the second grid area including randomly selecting a symbol for each unoccupied cell in the second display grid, wherein the randomly selected symbol(s) and the copied occurrence (s) of the predetermined symbol form a secondary bonus game outcome.

14. The control method, as set forth in claim 13, wherein the control unit is further configured to award a secondary bonus award to the player as a function of the secondary bonus game outcome.

15. The control method, as set forth in claim 14, wherein the control unit is further configured to award a free game award to the player as a function of each interim outcome for each free game.

16. The control method, as set forth in claim 13, the first grid having a plurality of columns, wherein each column defines a reel of the video slot game, the method including the step of selecting the plurality of symbols to display in the first plurality of cells of the first grid in a manner to simulate rotating reels, the plurality of symbols being displayed in the first plurality of cells of the first grid when the simulated rotating reels are stopped.

17. The control method, as set forth in claim 16, wherein each column has an associated reel strip, each reel strip including a plurality of symbol positions populated with a respective symbol.

18. The control method, as set forth in claim 17, wherein the secondary bonus game is a video slot game.

19. The control method, as set forth in claim 13, wherein the predetermined symbol is a wild symbol.

20. The control method, set forth in claim 13, wherein the complimentary award includes a number of credits.

21. The control method, as set forth in claim 20, wherein the number of credits is randomly determined.

22. The control method, as set forth in claim 13, wherein the complimentary award includes a progressive jackpot.

23. The control method, as set forth in claim 13, wherein the complimentary award includes one or more additional free games.

24. The control method, as set forth in claim 13, wherein the second display area is displayed over the first display area.

25. A gaming machine for providing a game, comprising:

an operation unit including a plurality of input buttons configured to receive an operation of a player;

a display unit including at least one display device, the at least one display device configured to display computer-generated graphics; and, a control unit operably coupled to the operation unit and the display unit, the control unit including a processor for generating the game on the at least one display device, the processor programmed to display a first display area and a second display area on the at least one display device, the first display area including a first plurality of cells arranged in a first grid, the second display area including a second plurality of cells arranged in a second grid, the processor of the control unit, in response to the operation of the player, being further programmed to initiate the game and to responsively:

randomly select a plurality of symbols associated with the first display area, each symbol in the plurality of symbols being associated with one of the plurality of cells in the first grid, the plurality of symbols forming an outcome associated with the first grid;

detect an occurrence of a predetermined symbol in the first display area, the occurrence of the predetermined symbol being associated with one of the first plurality of cells of the first display area; and copy the occurrence of the predetermined symbol from the first display area to a corresponding cell in the second grid of the second display area, wherein any copied occurrence of the predetermined symbol in the second grid forms, at least in part, an outcome associated with the second grid, wherein a complimentary award is provided to the player if the corresponding cell in the second display area is already occupied with an occurrence of the predetermined symbol.

26. A control method for providing a game to a player using a gaming machine, the gaming machine including an operation unit, a display unit, and a control unit, the operation unit including a plurality of input buttons being configured to receive an operation of a player, the display unit including at least one display device, the at least one display device configured to display computer-generated graphics, the control unit including a processor for generating the game on the at least one display device, the processor operably coupled to the operation unit and the display unit, the control method including the processor performing the steps of:

displaying a first display area and a second display area on the at least one display device, the first display area including a first plurality of cells arranged in a first grid, the second display area including a second plurality of cells arranged in a second grid;

initiating the game in response to operation of the player;

randomly selecting a plurality of symbols associated with the first display area, each symbol in the plurality of symbols being associated with one of the plurality of cells in the first grid, the plurality of symbols forming an outcome associated with the first grid;

detecting an occurrence of a predetermined symbol in the first display area, the occurrence of the predetermined symbol being associated with one of the first plurality of cells of the first display area; and, copying the occurrence of the predetermined symbol from the first display area to a corresponding cell in the second grid of the second display area, wherein any copied occurrence of the predetermined symbol in the second display area forms, at least in part, an outcome associated with the second grid, wherein a complimentary award is provided to the player if the corresponding cell in the second display area is already occupied with an occurrence of the predetermined symbol.

* * * * *